US009476013B2

(12) United States Patent
Van Der Eerden et al.

(10) Patent No.: US 9,476,013 B2
(45) Date of Patent: Oct. 25, 2016

(54) BUILDER GRANULES AND PROCESS FOR THEIR PREPARATION

(75) Inventors: Joris Van Der Eerden, Eben-Emael (BE); Roger Janssen, Riemst (BE); Remco Visseren, Maastricht (NL)

(73) Assignee: PQ SILICAS BV, Eijsden (NL)

( * ) Notice: Subject to any disclaimer, the term of this patent is extended or adjusted under 35 U.S.C. 154(b) by 88 days.

(21) Appl. No.: 14/115,226

(22) PCT Filed: Jun. 11, 2012

(86) PCT No.: PCT/GB2012/051313

§ 371 (c)(1),
(2), (4) Date: Nov. 1, 2013

(87) PCT Pub. No.: WO2012/168739

PCT Pub. Date: Dec. 13, 2012

(65) Prior Publication Data

US 2014/0073554 A1 Mar. 13, 2014

(30) Foreign Application Priority Data

Jun. 9, 2011 (GB) ..... 1109608.8

(51) Int. Cl.
*C11D 3/33* (2006.01)
*C11D 3/08* (2006.01)
*C11D 11/02* (2006.01)

(52) U.S. Cl.
CPC . *C11D 3/33* (2013.01); *C11D 3/08* (2013.01); *C11D 11/02* (2013.01)

(58) Field of Classification Search
CPC ..... C11D 3/33
USPC ..... 510/533
See application file for complete search history.

(56) References Cited

U.S. PATENT DOCUMENTS 4,539,133 A * 9/1985 Boskamp ..... C11D 3/08 510/321
5,786,313 A * 7/1998 Schneider ..... A23C 7/02 134/2
6,150,324 A * 11/2000 Lentsch ..... C11D 3/044 510/222
6,174,852 B1 * 1/2001 Hayashi ..... C11D 1/83 510/351
6,211,141 B1 * 4/2001 Yamaguchi ..... C11D 1/83 510/276
8,455,422 B2 * 6/2013 Somerville Roberts ..... C11D 17/06 510/220
2008/0261848 A1 * 10/2008 Hernandez ..... C01B 33/32 510/218
2010/0144576 A1 * 6/2010 Klein ..... C11D 3/0073 510/228
2010/0275396 A1 * 11/2010 Nakano ..... C08F 2/10 15/104.93
2011/0054215 A1 * 3/2011 Euser ..... C07C 227/40 562/571
2012/0046491 A1 * 2/2012 Mrzena ..... C07C 227/42 560/171
2012/0071381 A1 * 3/2012 Mrzena ..... C11D 3/33 510/218
2012/0149936 A1 * 6/2012 Baranyai ..... C07C 227/42 560/171
2012/0248370 A1 10/2012 Oftring et al.
2013/0000370 A1 1/2013 Lang
2013/0102514 A1 4/2013 Hueffer et al.
2013/0102515 A1 4/2013 Hueffer et al.
2013/0102516 A1 4/2013 Hueffer et al.
2013/0165689 A1 6/2013 Baumann et al.
2013/0210692 A1 8/2013 Gutowski et al.
2013/0274167 A1 10/2013 Gutowski et al.
2013/0284210 A1 10/2013 Hueffer et al.
2013/0284211 A1 10/2013 Garcia Marcos et al.
2013/0288941 A1 10/2013 Hueffer et al.
2014/0073554 A1 * 3/2014 Van Der Eerden ..... C11D 3/08 510/533

FOREIGN PATENT DOCUMENTS

DE 102009038951 A1 3/2011
NL WO 2009103822 A1 * 8/2009 ..... C07C 227/40
WO 2010133617 A1 11/2010
WO 2013185074 A2 12/2013

OTHER PUBLICATIONS

International Search Report for PCT/GB2012/051313 dated Dec. 10, 2012.

* cited by examiner

*Primary Examiner* — Mark Eashoo
*Assistant Examiner* — M. Reza Asdjodi
(74) *Attorney, Agent, or Firm* — Buchanan Ingersoll & Rooney PC

(57) ABSTRACT

A process for preparing builder granules suitable for use in a granular or tabletted detergent compositions, particularly for machine dishwash, involves forming a slurry of solid and aqueous MGDA Na3 spray dryer, under non-agglomerating conditions, to form spray dried particles comprising solid crystalline MGDA Na 3 dihydrate, compacting the spray dried particles into compacted aggregates and comminuting the compacted aggregates into granular particles to form builder granules having a particle size distribution suitable for use in a granular detergent composition. Prior to spray drying, the slurry is maintained at a slurry temperature of 20° or more for sufficient time for the resulting builder granules to remain free flowing after 48 hours storage at 20° C. and 65% relative humidity. The resulting granules, made by an efficient process, using conventional detergent manufacturing apparatus, exhibit excellent resistance to caking when damp and can be incorporated into granular detergent compositions or detergent tablets, such as machine dishwash compositions or tablets, without substantial degradation of flow or stickiness (for granular compositions) and without substantial reduction in friability or disintegration (for tabletted compositions).

20 Claims, 5 Drawing Sheets

BUILDER GRANULES AND PROCESS FOR THEIR PREPARATION

CROSS REFERENCE TO RELATED APPLICATIONS

Figure 1:
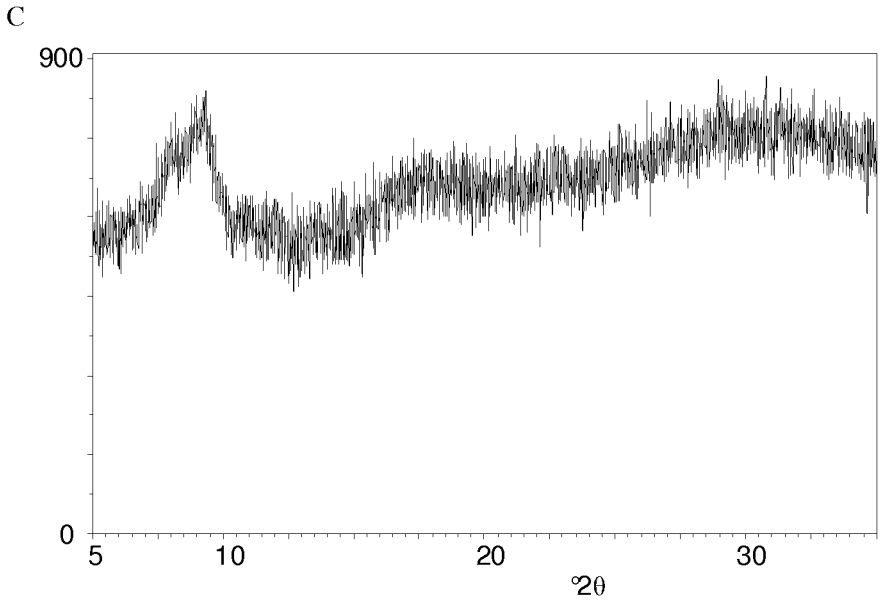

This application is the United States national phase under 35 U.S.C. §371 of PCT International Patent Application No. PCT/GB2012/051313, filed on Jun. 11, 2012 and claiming priority to United Kingdom Application No. 1109608.8, filed on Jun. 9, 2011, and incorporated by reference herein.

FIELD

The invention relates to processes for the formation of builder granules suitable for use in granular detergent compositions or detergent tablets, particularly granular compositions used for machine dishwashing, or used for preparing tablets for use in machine dishwashing. In particular, the invention relates to builder granules containing MGDA (methylglycine diacetic acid) salt, in particular the sodium salt MGDA $Na_3$ in hydrated crystalline form.

BACKGROUND

Detergent compositions, such as fabric washing compositions and machine dishwashing compositions may be provided in the form of granular compositions or as tablets compacted from granular compositions. Such detergent compositions typically comprise a builder in order to improve detergency and to reduce the negative effects of hardness ions such as calcium or magnesium from hard water which may be used during the washing process. For ecological and regulatory reasons, the use of phosphates as builders is now highly undesirable, and in some countries, and under certain circumstances, is forbidden.

Chelating agents suitable for use as replacements for phosphate include compounds such as MGDA salts. These have the benefit of being both biodegradable and obtainable from renewable sources. MGDA is methylglycine diacetic acid, which in its acid form has three acid protons which may be replaced by other cations to form salts.

MGDA salts are usually provided commercially as an aqueous solution having an active (i.e. anhydrous solid) content from 35 to 50% by weight of MGDA salts. Usually, the trisodium salt is used (referred to in the art as MGDA $Na_3$) and such material is widely available commercially, from companies of the BASF group.

In order to use MGDA salts as a builder or chelant in granular detergent compositions, the aqueous solution of MGDA salt may be dried in order to form builder particles or granules in solid form. However, such granules have been found, in the prior art, to exhibit extreme hygroscopic behaviour which is undesirable in granular detergent compositions. Such hygroscopic behaviour, characterised by uptake of moisture from the ambient surroundings, may render granules cohesive, leading to storage, handling and manufacturing difficulties arising from poor flow properties. The formulations containing such granules may even set or solidify into a solid mass when stored at high humidity. In particular, it is well established from the prior art that MGDA powder produced by conventional spray-drying of aqueous MGDA solution has unacceptable caking behaviour when subject to water uptake as a result of hygroscopicity of the powder.

Furthermore, when such builder granules are incorporated into detergent tablets, typically formed by compaction of a variety of granules of differing types, the presence of hygroscopic granules may have an adverse effect upon the disintegration characteristics, dissolution behaviour and cohesiveness of the resulting tablet, following storage. Redistribution of moisture from other granular ingredients to the builder granules, or uptake of moisture from the ambient atmosphere, may lead to changes in the characteristics of tablets over time and may lead to granules being cemented together in the tablet in an undesirable fashion, leading to reduction in disintegration and dissolution rate for such tablets in use.

The organic nature of builders, such as MGDA salts may also lead to their presence in formulations having an adverse effect on explosion risks in factories where the material is handled, when they are present at an effective level as builder in compositions. The high organic content of dust in the atmosphere derived from attrition arising during processing of such builder granules may result in ignition or explosion risk. High levels of organic material may also give rise to storage problems arising from self-heating of warm granules, when they are held in hoppers or storage silos, arising from spontaneous auto-oxidation at elevated temperatures, potentially giving rise to dangerous, run-away self-heating effects. Individual granules to be stored in bulk should be free from risk of self-heating when subjected to high ambient temperatures.

EP 1803801, WO 2006/002954, and GB 2415695 describe the use of polymeric coating materials on builder granules including MGDA salts, applied to tackle the problems of hygroscopicity for such chelating agents when used as detergent builders.

WO 2010/076291 discloses coated particles containing chelating agents such as MGDA salts wherein the coating agent is a scale-inhibiting additive-containing material.

U.S. Pat. No. 5,981,798 discloses a crystalline solid with low hygroscopicity which essentially consists of MGDA derivatives (salts) and which is prepared by adjusting the water content of a starting material containing the MGDA derivatives to a value from 10 to 30% by weight based upon the starting material then subsequently bringing about crystallisation of the solid MGDA derivative. This publication also states "Spray-drying processes (e.g. in a spray tower or spray fluidized bed) by contrast result in an amorphous solid. In this form, the solid is often highly hygroscopic and, on open storage under ambient conditions, its. flowability is lost within a short time."

WO 2010/133618 discloses a process for preparing a powder containing MGDA derivatives, such as the sodium salt of MGDA, wherein the resulting product comprises a powder having MGDA salt said to have a degree of crystallinity greater than or equal to 30%. The process disclosed requires a starting material which is an aqueous solution comprising the MGDA salt in a concentration range from 20 to 60% based on the total weight of the aqueous solution. In a first process step, the aqueous solution is concentrated in an evaporator with rotating internals which are arranged a distance from the inner wall of the evaporator of less than or equal to 1% of the diameter of the evaporator to give a crystal slurry having a solid concentration in the range from 60 to 85% by weight, based on a total weight of the crystal slurry. In a second process step, the crystal slurry is allowed to mature in a paste bunker and then in a thin-film contact dryer, wherein the total dwell time in the paste bunker and in the thin-film contact dryer is greater than or equal to 15 minutes. This publication also explains that powders are produced industrially in spray-drying plants, which leads to solids with high amorphous fractions. It is stated that this leads to highly hygroscopic behaviour and poor storability and further processability (for instance in tabletting presses). The publication discloses two MGDA $Na_3$ crystalline states (referred to in this present specification as monohydrate and as dihydrate) obtained by the process disclosed in WO 2010/133618.

WO 2009/103822 discloses a process for the preparation of free-flowing granules of low hygroscopicity containing one or more MGDA salts. The process comprises the steps of heating a concentrated slurry comprising the MGDA salts to a temperature in the range 50 to 120° C., wherein the slurry has a solid content in the range of 45 to 70%. The slurry is then spray-granulated in a spray-granulator using an air inlet temperature of 120° C. or less. The document explains that in spray-granulation, it is the objective to spray the slurry onto existing seeds in the drying chamber and to dry the slurry at that location so the seeds grow into granules. Only when the granules reach a certain particle size is the product discharged from the equipment. Such spray-granulation equipment is not conventional granulation equipment used traditionally in the detergent industry, and typically operates at lower production rates than equivalent conventional spray-drying equipment. In its introduction, this publication states: "Particles of MGDA made via conventional spray drying processes tend to be fine and dusty, have a high tendency to absorb water at ambient conditions and loose their free-flowiness. The resulting products are hygroscopic, resulting in sticky powder and even in lumps."

SUMMARY OF THE INVENTION

It is one object of the invention, amongst others, to provide builder granules suitable for use in granular detergent compositions or for use in the preparation of detergent tablets, for instance prepared by compaction of granules, where the builder granules include levels of MGDA salt sufficiently high to be effective as builder and do not show high levels of hygroscopicity. It is also an object of the invention to provide builder granules containing high levels of MGDA salt which are not susceptible to self heating through oxidation when used in detergent compositions detergent tablets and stored at high temperatures. It is also an object of the invention to provide a process for preparing builder granules containing high levels of MGDA salt which may be carried out on conventional detergent processing apparatus, in particular making use of conventional spray drying towers, operated under non-agglomerating conditions, in order to provide energy efficient and rapid drying. It is also an object of the invention to provide a process without any special cleaning requirements for the processing apparatus used for preparing the builder granules of the invention (i.e. no special additives such as benzoic acid to be added). It is a further object of the invention to provide an efficient process delivering builder granules rich in MGDA salt so that material otherwise rejected from the process may be recycled back into the process to avoid wastage.

A first aspect of the invention provides a process for preparing builder granules suitable for use in a granular detergent composition or detergent tablet, the process comprising:

A) forming a slurry comprising seed particles of solid MGDA $Na_3$ dispersed in an aqueous solution of MGDA $Na_3$, B) spray drying the slurry in a spray dryer, under non-agglomerating conditions, with a slurry temperature of 20° C. or more and an inlet temperature for drying air from 150° C. to 350° C., to form spray dried particles comprising solid crystalline MGDA $Na_3$ dihydrate, with at least 90% by weight of the spray dried particles having a diameter less than 300 μm, C) compacting the spray dried particles into compacted aggregates, and D) comminuting the compacted aggregates into granular particles to form the builder granules, wherein the slurry is maintained at the slurry temperature, for an ageing time of at least a minimum ageing period, to form an aged slurry prior to spray drying, the minimum ageing period being sufficiently long for the resulting builder granules to remain free flowing after 48 hours storage at 20° C. and 65% relative humidity.

A second aspect of the invention provides builder granules, suitable for use in a granular detergent composition or detergent tablet, obtained or obtainable by the process of the first aspect of the invention.

A third aspect of the invention provides builder granules, suitable for use in a granular detergent composition or detergent tablet, comprising from 5 to 15% by weight of water, from 50 to 90% by weight of MGDA $Na_3$ salt and from 5 to 20% by weight of alkali metal silicate having a molar ratio of $SiO_2/M_2O$ from 1.0 to 3.5, wherein M is an alkali metal and wherein R, the weight ratio of MGDA salt/alkaline silicate in the builder granules, is 3.5 or more, and wherein MGDA $Na_3$ salt is present as solid crystalline MGDA $Na_3$ dihydrate in the builder granules.

DETAILED DESCRIPTION OF THE INVENTION

Throughout this specification, the term "comprising" or "comprises" means including the component(s) specified but not to the exclusion of the presence of others. The term "consisting essentially of" or "consists essentially of" means including the components specified but excluding other components except for materials present as impurities, unavoidable materials present as a result of processes used to provide the components, and components added for a purpose other than achieving the technical effect of the invention. Typically, a composition consisting essentially of a set of components may comprise less than 10% by weight, typically less than 5% by weight, more typically less than 1% by weight of non-specified components. For instance, depending upon the method used for the preparation of MGDA $Na_3$ salt, the purity of the material may typically be in the range 70 to 99% by weight, more usually in the range 80 to 99% by weight calculated on anhydrous dry matter content. The other components inevitably present will be impurities resulting from the production process used to form the MGDA salt.

Whenever appropriate, the use of the term "comprises" or "comprising" may also be taken to include the meanings "consists of"/"consisting of" or "consists essentially of"/"consisting essentially of".

Any reference in this specification to MGDA salt or salts is meant to include MGDA either in its acid form or fully or partly neutralized as a salt. Impurities which may be present in commercial MGDA are not included as part of the MGDA salt or salts. The MGDA salt used for the invention is the sodium salt, also referred to as MGDA $Na_3$. The percentage by weight of MGDA salt is calculated based upon the MGDA being present as MGDA $Na_3$, even if this is not necessarily the case. For instance, some of the MGDA may be present as MGDA $Na_2H$ salt, even though it is referred to as MGDA $Na_3$. The weight percentage of MGDA salt is expressed as 100 times the weight of the equivalent amount of MGDA $Na_3$ divided by the total weight of composition. For this calculation, water of hydration, which may be present in solid crystalline phases of MGDA salts, is not included as part of the weight equivalent amount of MGDA $Na_3$, even though the MGDA $Na_3$ may be present as a hydrated crystalline solid. The water of hydration is included as part of the remainder of the total composition counted separately from the MGDA $Na_3$.

By MGDA is meant methylglycine diacetic acid, also referred to in the art as α-alanine-N,N-diacetic acid. This compound and its salts are chiral in nature, and the term MGDA as used herein includes either the racemate or enantiomerically pure versions of the compound or its salts (i.e. R- or S-enantiomers, based on the Cahn, Ingold, Prelog rules, also referred to as d- or l-enantiomers, based upon optical activity).

MGDA $Na_3$ may exist as an amorphous solid, by which it is meant that a powder x-ray diffraction spectrum of the material shows no sharp crystalline peaks, or it may exist in a various crystalline states. Two hydrated crystalline states are referred to herein as MGDA $Na_3$ monohydrate and MGDA $Na_3$ dihydrate (although these terms are not intended to limit the crystalline states mentioned, and in order to identify the structures, reference should be made to their XRD spectra as set out hereinafter).

For the monohydrate, as referred to herein, the XRD spectrum generated using Cu-K α-radiation exhibits the following pattern, in which θ is the diffraction angle and d the corresponding spacing from the crystal structure:

MGDA $Na_3$ Monohydrate

| 2θ | d value (Ångstrom) |
|---|---|
| 8.4 | 10.5 |
| 9.5 | 9.3 |
| 11.1 | 8.0 |
| 13.2 | 6.7 |
| 13.9 | 6.35 |
| 15.8 | 5.6 |
| 16.5 | 5.36 |
| 16.84 | 5.26 |
| 17.34 | 5.11 |
| 17.67 | 5.02 |
| 18.92 | 4.69 |
| 20.29 | 4.37 |
| 21.71 | 4.09 |
| 22.3 | 3.98 |
| 23.09 | 3.85 |
| 24.74 | 3.59 |
| 25.36 | 3.51 |
| 27.04 | 3.29 |
| 28.28 | 3.15 |
| 29.63 | 3.01 |
| 30.09 | 2.97 |

For the dihydrate, as referred to herein, the XRD spectrum generated using Cu-K α-radiation exhibits the following pattern:

MGDA $Na_3$ Dihydrate

| 2θ | d value (Ångstrom) |
|---|---|
| 8.2 | 10.80 |
| 10.5 | 8.40 |
| 15.55 | 5.70 |
| 16.47 | 5.38 |
| 17.09 | 5.18 |
| 18.10 | 4.90 |
| 18.82 | 4.71 |
| 21.00 | 4.23 |

-continued

| 2θ | d value (Ångstrom) |
|---|---|
| 21.35 | 4.16 |
| 22.64 | 3.92 |
| 23.69 | 3.75 |
| 24.73 | 3.60 |
| 26.75 | 3.33 |
| 28.93 | 3.08 |
| 29.88 | 2.99 |
| 31.46 | 2.84 |
| 31.88 | 2.80 |

The optional and/or preferred features set out may be used either individually or in combination with each other where appropriate and particularly in the combinations as set out in the accompanying claims. The optional and/or preferred features for each aspect or arrangement of the invention set out hereinafter are also applicable to any other aspects or arrangements of the invention, where appropriate.

The first aspect of the invention provides a process for preparing builder granules suitable for use in a granular detergent composition or detergent tablet. In particular, the builder granules are suitable for use in machine dishwash compositions and tablets. The process comprises (A) forming a slurry comprising seed particles of solid MGDA $Na_3$ dispersed in an aqueous solution of MGDA $Na_3$. Typically the slurry will be at a slurry temperature of 20° C. or more, up to the boiling temperature of the slurry which may be 100° C. or greater, such as about 110° C. depending upon the concentration of the aqueous solution of the slurry and the components present. This increase in boiling point over 100° C. for pure water is well known as a colligative property.

The process of the invention involves the solid seed particles comprising solid MGDA $Na_3$ salt. Suitably the solid seed particles are of MGDA $Na_3$, meaning that they comprise at least 50% by weight, preferably at least 70% by weight of solid MGDA salt. More preferably, the solid seed particles may consist essentially of solid MGDA salt and water, which may include crystalline water of hydration, or may be anhydrous MGDA salt prior to addition into the slurry. Preferably, the solid seed particles may contain MGDA $Na_3$ in its dihydrate form as measured by x-ray diffraction analysis.

MGDA $Na_3$ sodium salt is commercially available under the trade name Trilon™ as supplied by BASF.

Commercially, the MGDA salt may be available as an aqueous solution of the trisodium salt or may be supplied in a powder or granular form with amorphous, monohydrate and/or dihydrate crystalline state. The MGDA salt for use in the invention is not limited to the commercially available material, although this may suitably be used. MGDA in its acid form may be used and neutralised to form MGDA $Na_3$, for instance using caustic soda or alkaline silicate solution.

MGDA $Na_3$ salt is available commercially in aqueous solutions having an MGDA $Na_3$ concentration typically from 30% or 35% by weight to say 50% by weight, such as about 39% to about 45% by weight. The remainder of the commercial aqueous solution is water and impurities, such as salts, present as production impurities with commercially obtained MGDA salt and arising from its preparation.

By aqueous solution it is meant that the solvent used is water. Other liquids may be present as part of the solvent, but typically at levels less than 5% by weight of the slurry composition. The aqueous solution is an aqueous solution of MGDA $Na_3$, by which it is meant that the aqueous solution comprises MGDA $Na_3$ as major ingredient by weight (other than water) and will typically contain at least 30% by weight or more of MGDA $Na_3$, such as 40% by weight or more or even 50% by weight or more. Other ingredients are not intended to be excluded by the term "of MGDA $Na_3$", and impurities may be present in the aqueous solution of MGDA $Na_3$ as well as deliberately added ingredients, such as alkali metal silicate, as set out hereinafter.

Other water-soluble solid materials, such as alkali metal silicates, may also be present in the aqueous solution of the slurry as added materials as set out hereinafter. Preferably, the aqueous solution is saturated or near-saturated with the MGDA $Na_3$ salt at the slurry temperature to be used for the process of the first aspect of the invention.

The concentration of MGDA $Na_3$ salt required to achieve saturation will depend upon the temperature and the other soluble ingredients, such as sodium silicate, present in the aqueous solution, but may be easily assessed by preparing aqueous solutions of varying concentrations of MGDA $Na_3$ salt at the required temperature and assessing whether they are clear solutions or contain solids, saturation being the concentration above which solids are first formed. This may be assessed by titration. By "near-saturation" is meant an MGDA $Na_3$ salt concentration less than saturation but within 5% by weight of the MGDA $Na_3$ salt concentration required for saturation at a particular temperature.

Similarly, reference herein to the seed particles being seed particles of solid MGDA $Na_3$ means that the seed particles comprise solid MGDA $Na_3$ as the major component present by weight in the seed particles (i.e. 50% by weight or more of the seed particles is solid MGDA $Na_3$).

The seed particles in the aged slurry may be of crystalline MGDA $Na_3$ dihydrate. When it is stated herein that the seed particles are of crystalline MGDA $Na_3$ dihydrate, it is meant that the seed particles comprise 50% or more by weight of MGDA $Na_3$ salt, as proportion of the dried solids (excluding water) and that the MGDA $Na_3$ salt is substantially present as crystalline MGDA $Na_3$ dihydrate (in other words, the MGDA $Na_3$ in the seed particles exhibits the crystal structure of the dihydrate form with a degree of crystallinity of 30%, preferably 50% or more, measured by powder x-ray diffraction as set out hereinafter). This may be checked by isolating seed particles from the slurry, following ageing, by vacuum filtration at the slurry temperature, and by carrying out a powder XRD analysis on the isolated and subsequently dried seed particles (as set out elsewhere herein).

The next step (B) requires spray drying the slurry in a spray dryer, under non-agglomerating conditions, with a slurry temperature of 20° C. or more and an inlet temperature for drying air from 150° C. to 350° C., to form spray dried particles comprising solid crystalline MGDA $Na_3$ dihydrate, with at least 90% by weight of the spray dried particles having a diameter less than 300 μm. The spray drying is carried out after maintaining the slurry at a slurry temperature for an ageing period sufficient to ensure that the eventual builder granules prepared by the process are free flowing following water uptake due to hygroscopicity. The requirements for the ageing period are set out below.

Suitably, the MGDA $Na_3$ in the spray dried particles resulting from step (B) is substantially in the form of MGDA $Na_3$ dihydrate, as measured by XRD.

Suitably, the degree of crystallinity of the MGDA $Na_3$ dihydrate, measured as set below, is 30% or more, preferably 50% or more. Preferably, the seed particles are substantially free of MGDA $Na_3$ monohydrate, meaning that distinct sharp peaks corresponding to the monohydrate structure, as set out in the Table above, are absent from the x-ray diffractogram of the seed crystals or are present with a degree of crystallinity of 10% or less, such as 5% or less.

Spray drying is well known in the field, and may be carried out in a co-current or a counter-current spray drying apparatus. With a co-current spray dryer, slurry droplets are formed, typically using a nozzle or nozzles or a spinning disc droplet generator, and projected down the inner space of a tower, falling under gravity, with a hot air flow through the tower from top to bottom, so that the slurry droplets flow along with the hot air towards the base of the tower where they are collected as dried particles. With a counter-current spray dryer, slurry droplets are formed, typically using a nozzle or nozzles or a spinning disc droplet generator, and projected down the inner space of a tower, falling under gravity, with a hot air flow through the tower from bottom to top, so that the slurry droplets fall through the tower counter to the hot air flow up the tower. As heat is transferred from the hot air to the slurry droplets, these dry by evaporative moisture loss with the resulting moisture vapour carried in the hot air and with the latent heat of vaporisation provided by the hot air, resulting in consequent cooling of the hot air between the hot air inlet and outlet to the tower. Under such circumstances, the air exiting from the spray dryer may be expected to exit at a temperature from 90° C. to 120° C. Similarly, the spray dried particles will be at a similar temperature, or lower, on collection from the spray dryer.

Preferably, the spray-drying step (C) is operated in order to yield a moisture content for the spray-dried particles from 5 to 15% by weight, for instance 8% to 14% by weight.

The moisture content of the spray dried particles may suitably be measured by chemical analysis of the spray-dried particles.

For instance, the moisture content of the granules may be measured as follows. The amount of MGDA chelating agent contained within the granules is measured for the granules by titration against iron (III) chloride. The amount of impurities present from the source of MGDA salt is derived by calculation from the amount of MGDA measured, using the impurity level and salt content as cited by the supplier, (alternatively, direct measurement of water in the MGDA source may be measured by Karl Fischer titration, with the MGDA measured by iron (III) titration to derive an impurity content). When alkali metal silicate is present in the granules, the $SiO_2$ content of the granules is measured by titration using standard titration methods (such as ISO 2124-1972 using titration with sodium fluoride) in order to obtain an $SiO_2$ content by weight. The $SiO_2/M_2O$ ratio is known from the formulation used for preparing the granules and so the amount of $M_2O$ may be derived. The amounts of any other components present may be derived from the formulation used for the slurry and the amount of MGDA measured, by proportion to the MGDA measured. The moisture content is thus arrived at by subtraction of the known solid components (MGDA and salt/impurities, alkali metal silicate, other solids) from 100% for the granules.

By "non-agglomerating conditions" it is meant that the spray dryer is controlled to provide rapid drying of slurry the droplets following their formation, so that the droplets do not agglomerate, but instead are dried in a manner such that each droplet may form a single, separate dried particle. The rapid drying from slurry droplet to solid particle means that dried particles are not grown or granulated by a layering or coating process. Such non-agglomerating operation is well known in the art, and the process of the invention is particularly suitable for use with a co-current spray dryer apparatus or tower operated under non-agglomerating conditions. Typically, the residence time in the spray drying apparatus, from slurry droplet formation to exit of dried solid particle from the apparatus will be of the order of a few seconds, typically less than 30 seconds, or less than one minute. Although a small proportion of particles may collide and agglomerate in the apparatus, to form clusters of 2 or 3, or even more, particles, the predominant drying mechanism will be such that one droplet becomes one dried particle.

Such conditions typically generate dried particles having a particle size with at least 90% by weight less than 300 μm in diameter (for instance as measured by air sieving). Typically, removal of fines during the spray-drying process (for instance by means of cyclones) means that at least 90% by weight of the spray-dried particles emerging from the spray-dryer will be from 5 to 300 μm in diameter. Typically, a collection point may be provided with a conveying means, such as a conveyor belt, at the base of the spray dryer, to remove the spray dried particles for collection. The median diameter of the spray dried particles may be typically from 30 to 60 μm. All particle sizes are based on weights of the particles measured, so the median diameter for a sample means that 50% by weight of the sample is contained in particles which have a diameter less than the median diameter.

A typical spray drying arrangement will have one or more cyclonic dust separators and filters for collection of fine solid particles emerging with the exhaust gases from the spray-dryer in order to prevent these from being released to the ambient atmosphere as pollutants. Such material, which would otherwise be considered as waste material from the process, may be recycled as MGDA $Na_3$ for further slurry formation.

This may be contrasted with prior art spray granulation or spray agglomeration processes, such as those set out in the "Background" section of this specification, where spray agglomeration is used to form granules by retaining particle within a spray dryer tower (for instance by fluidisation with an air counter-current) and operating at lower air temperatures so that slurry droplets coat pre-formed, suspended particles in the apparatus and dry slowly on those particles to form layered granules. Such processes typically involve long residence times of greater than one minute and require the highest hot air temperature to be maintained below 120° C. to avoid thermal degradation or decomposition of the MGDA salt, as the long residence times used may mean that the particles may become so dry that their temperature is no longer limited by the boiling of water from the particles, and so the particle temperature may approach the hot air temperature.

The slurry temperature used for spray drying in the process of the invention may typically be 20° C. or more, such as 40° C. or more or 60° C. or more, for instance 70° C. or more, and may be up to 90° C., but may also be higher, such as up to the boiling point of the slurry. As the slurry may be pressurised for spray drying, and given that the aqueous solution of the slurry includes high concentrations of dissolved materials, the boiling point of the slurry may be higher than 100° C. immediately prior to spraying into the dryer, such as 120° C. This may be achieved by means of heat exchange in the inlet feeding the spray droplet generator (typically the spray droplet generator may be a nozzle or nozzles or a spinning disc droplet generator). MGDA $Na_3$ may decompose at temperatures in excess of 120° C. and so slurry temperatures in excess of 120° C. are to be avoided if degradation of the MGDA salt is to be prevented. Although the hot air in the spray drying apparatus may have a temperature considerably higher than 120° C., the drying droplets themselves will not attain such high temperatures because the drying droplet temperature will be limited to the boiling point of the aqueous solution evaporating from the slurry droplets as the droplets dry in the air stream, provided that the dryer is operated to ensure that the resulting spray dried particles still have a significant moisture content upon exit from the spray dryer after drying, such as from 5 to 15% by weight. The air inlet temperature for spray drying in the process of the invention is from 150° C. to 350° C., such as from 180° C. to 300° C., for instance from 200° C. to 250° C. At exit from the spray dryer, the air temperature may be from 85 to 150° C. such as from 90° C. to 120° C. At temperatures below 20° C., practical operation of spray drying is not realistic, and the kinetics of dihydrate formation in the slurry may become too slow to be practical for commercial use.

A milling apparatus may be included as part of the means for conveying the slurry to the droplet generator, with the milling apparatus acting to grind or comminute the excess solid seed particles present in the slurry to a size such that the solid seed particles are sufficiently small to prevent them acting to block any nozzle orifices of the droplet generator.

Where a spray nozzle or nozzles are used as droplet generator, the slurry may enter each nozzle at a pressure of say 10 to 14 MPa, such as 12 to 13 MPa. The nozzle orifice exit diameter may suitably be from 2.6 to 3.7 mm in order to generate suitably sized slurry droplets. The details of the pressure and nozzle diameter are not particularly important provided that the droplets generated are suitably 500 μm or less in diameter, such as 400 μm or less or 300 μm or less. Any suitable slurry feed pressure and droplet generator arrangement may be used to arrive at suitable slurry droplets formed in the spray dryer.

The solid seed particles, which are mixed with the aqueous solution having MGDA salt dissolved therein, may partially dissolve in the aqueous solution during ageing, prior to spray drying, but sufficient solid seed particles should be present to ensure that some solid seed particles remain undissolved in the aged slurry so that the aged slurry still has solid seed particles dispersed therein immediately prior to spray drying. Suitably, the slurry formed in step (A) may comprise from 5% to 45% by weight of solid seed particles at initial formation, prior to any equilibration involving dissolution of solid seed particles into the aqueous solution, and from 3% to 15% by weight of solid seed particles after ageing (with some of the solid seed particles having dissolved into the aqueous solution to bring it to saturation or near saturation at the slurry temperature).

Suitably, the aged slurry may comprise from 3% to 15% by weight of seed particles. The presence and weight percentage of solid seed particles present in the slurry may be measured by filtration of a 200 ml sample of the slurry, using vacuum filtration onto a Whatman™ grade 1 standard cellulosic filter paper at the slurry temperature, followed by drying the filter cake collected at 100° C. in a drying oven prior to weighing. The filtration apparatus is brought to a temperature of 105° C. by storage in an oven and removed immediately prior to filtration. Filtration is effected over 1-2 minutes. This weight percentage will include some solid arising from dried aqueous solution present in the slurry held in the filter cake, but in the absence of solid seed crystals in the slurry, no filter cake will arise.

The dried filter cake may also be analysed by XRD in order to assess the nature of the MGDA $Na_3$ and its crystalline state, and references to the crystalline state of the seed particles in this specification mean the state as measured in this way. A suitable method for measurement of the crystallinity of MGDA is as set out in the published patent application WO2010133618A1 and explained in more detail in the following paragraphs.

X-ray powder diffractograms may be made using Cu-K α-radiation for instance on a diffractometer D8 Advance® by Messrs. Bruker AXS (Karlsruhe), taken in reflection with a variable aperture setting on the primary and secondary sides.

The measuring range may be from 2° to 80° for 20, the step width 0.01° and the measuring time per angle step 3.6 seconds. The degree of crystallinity may be ascertained by determining the area percentage of the crystalline phase and the amorphous phase, and from these, the degree of crystallinity DC may be calculated as the proportion of the area of the crystalline phase $A_C$ relative to the total area consisting of the area of the amorphous phase $A_A$ and the area of the crystalline phase Ac: $DC=A_C/(A_C+A_A)$.

The degree of crystallinity, DC, may be performed with the help of a software program, for example the TOPAS® program from Bruker AXS.

Initially an amorphous sample (with no distinguishable crystalline peaks of either monohydrate or dihydrate MGDA $Na_3$) is measured and fitted, using a profile fit based upon six individual broad peaks. Then positions of these broad peaks as well as their peak width at half-height are fixed and these values are stored as the "amorphous phase".

Then, taking the sample for which the degree of crystallinity DC is to be determined, the area percentage of the crystalline phase and the area percentage of the amorphous phase are determined and from these the degree of crystallinity DC is calculated using the formula given above.

The amorphous phase to be used as a control is prepared by spray drying of MGDA $Na_3$ solution at 70° C. in the absence of any seed crystals, as set out hereinabove, using a hot air inlet temperature of 200° C. Details are as set out in Example 3 below.

The crystalline phase may also be defined via its individual line positions analogously to the amorphous phase. The background is fitted using a polynomial of the first degree. The TOPAS® program calculates the optimum fit between the measured diffractogram and the theoretical diffractogram consisting of the amorphous and crystalline phase, thus deriving a value for DC.

Suitably, the seed particles in the aged slurry comprise MGDA $Na_3$ present as MGDA $Na_3$ dihydrate, by which it is meant that the degree of crystallinity of the MGDA $Na_3$ dihydrate, measured as set out above, is 30% or more, preferably 50% or more. Preferably, the seed particles are free of MGDA $Na_3$ monohydrate, meaning that distinct sharp peaks corresponding to the monohydrate structure, as set out in the Table above, are preferably absent from the x-ray diffractogram.

The slurry may be initially formed at a temperature from 20° C. up to the boiling point of the slurry, say from 60° C. to 90° C., or maybe formed at a temperature below 20° C. and subsequently heated to a temperature, typically a constant temperature, somewhere in the range from 20° C. up to the slurry boiling point.

The spray-dried particles from step (B), which comprise solid crystalline MGDA $Na_3$ dihydrate, are compacted in step (C) into compacted aggregates, such as flakes, marumes, noodles, prills or the like. Any suitable apparatus may be used to compact the spray dried particles into compacted aggregates. The spray dried particles, when forced together under pressure, cohere to each other in order to form monolithic, compacted aggregates. Many forms of apparatus are known in the art for use to form compacted aggregates or monoliths from cohesive powders. For instance the compacted aggregates maybe formed using a compacting mill, also referred to in the art as a roller compacter, by passing the powder between rollers separated by a nip gap, or maybe formed into noodles by passing the powder through a noodling plate by means of a screw feed. Other methods include the use of prilling or marumerising apparatus or other agglomeration means such as high-speed rotary mixer-granulators. The requirement for such apparatus is that the spray dried particles are pressed together so that they adhere to each other to form a compacted aggregate, with air being squeezed out of the compacted aggregates in order to increase the overall density.

The compacted aggregates formed from the spray-dried powder may suitably have a minimum dimension of 300 μm or more, meaning that the smallest dimension of the compacted aggregates is 300 μm or more. For instance, if the compacted aggregates are in the form of sheets, ribbons or flakes formed by a compacting mill, then the thickness of the sheets or flakes should be 300 μm or more. If the compacted aggregates are in the form of rounded prills or marumes, then the smallest diameter, measured through the marume centroid, should be 300 μm or more. Where the compacted aggregates are in the form of noodles, the diameter of the noodles should be 300 μm or more, unless the noodle length is less than its diameter, in which case the length should be 300 μm or more. Typically, the compacted aggregates may be even larger in size, such as up to 1 mm or 2 mm, 4 mm or even up to 5 mm or 10 mm as minimum dimension. In a preferred arrangement, the compacted aggregates in step (D) may be formed by compacting the spray dried particles in a nip between rotating rollers to form a compacted sheet having a thickness from 1 to 4 mm. The rollers may have the spray dried powder fed to them by means of a screw feed arrangement, such as a twin feed screw.

The minimum desirable dimension for the compacted aggregates is to enable a substantial proportion of the compacted aggregates to yield builder granules of the required size to be suitable for use in granular detergent compositions or detergent tablet following the comminution of the compacted aggregates.

Compacting the spray dried particles into compacted aggregates is preferably carried out with a composition consisting essentially of the spray dried particles.

In other words, no liquid binders such as polyethylene glycol need to be added to the spray-dried particles prior to compaction, giving the benefits of process simplicity and rapid granular disintegration when the builder granules are put to their final use in a detergent composition by dissolution into a wash liquor.

The compacted aggregates are then (D) comminuted to form granular particles. Any suitable comminution route may be employed, such as a hammer mill or the like, in order to yield granular particles from the compacted aggregates.

Optionally, the granular particles resulting from comminution of the compacted aggregates in step (D) may be classified by removal of undesired granular particles. Typically such classification will involve the removal of oversized particles and or undersized particles in order to narrow the particle size distribution and to form builder granules having a particle size distribution suitable for use in a granular detergent composition or for use for compaction into detergent tablets.

Any oversize particles may be recycled to step (D) of the process of the first aspect of the invention again for further comminution, whereas undersize material may be recycled back to step (C) for compaction.

Suitably, for the builder granules produced by the process of the first aspect of the invention, at least 90% by weight, for instance at least 95% by weight, of the builder granules have a particle size from 200 to 1400 μm, preferably from 300 to 1200 μm, even more preferably from 500 to 800 μm as measured by sieving. This enables the builder granules to be used in granular detergent products and as component ingredients in formation of detergent tablets, along with other detergent ingredients of similar granular size. This particle size distribution may be achieved by classification using sieves.

The process of the invention is characterised by the slurry being maintained at the slurry temperature for an ageing time of at least a minimum ageing period to form an aged slurry prior to spray drying, the minimum ageing period being sufficiently long for the resulting builder granules to remain free flowing after 48 hours storage at 20° C. and 65% relative humidity.

A suitable test for checking whether the granules remain free-flowing after storage at 20° C. and 65% relative humidity for 48 hours involves taking a 10 g sample of the builder granules, classified using sieves to have a particle size from 200 to 1400 μm, and forming a horizontal layer of uniform thickness in the base of a Petri dish of 10 cm internal diameter (layer thickness typically from 0.5 to 3 mm) within 1 hour of formation of the builder granules, and storing the dish in a controlled environment for 48 hours prior to testing for free-flowing behaviour. If the granules can be made to flow freely as individual granules by shaking the dish horizontally, at about 4 to 6 Hz sinusoidal oscillation, with an amplitude of about 3 cm, then the builder granules are designated as "free flowing".

The minimum ageing period will depend upon the initial nature of the solid MGDA $Na_3$ of the seed particles used to prepare the slurry. When the seed particles are of MGDA $Na_3$ in the form of solid amorphous solid, a suitable minimum ageing period for maintaining the slurry at a temperature of 20° C. or more to provide sufficient time for the resulting builder granules to remain free flowing after 48 hours storage at 20° C. and 65% is 3 hours, such as 4 hours or even longer. The minimum ageing period will vary with the slurry temperature used, and longer times may be suitable for lower slurry temperatures with shorter times being acceptable for higher temperatures. In practice, it has been found that there is no requirement to age the slurry for longer than 12 hours at 60° C. or more when the solid seed particles are initially amorphous, although there is no detrimental effect on the free-flowing behaviour if the slurry is aged at the slurry temperature for longer periods such as up to 24 hours, for instance up to 36 hours or even up to 48 hours. Although such longer ageing times in excess of 12 hours may not necessarily lead to further improvement in the resulting builder granules, they may be useful for practical reasons such as when plant operation of a continuous process is suspended over a day or more, for instance over a weekend.

When the seed particles are of MGDA $Na_3$ substantially in the form of solid MGDA $Na_3$ dihydrate, no ageing period, other than a minimum period to achieve dispersion of the seed particles in the aqueous solution, may be necessary. Hence the minimum ageing period under such circumstances may be 5 seconds, such as 5 minutes, for instance 10 minutes or even longer.

Again, although longer ageing times in excess of 12 hours may not necessarily lead to further improvement in the resulting builder granules when the seed particles are initially of MGDA $Na_3$ substantially in the form of solid MGDA $Na_3$ dihydrate, such ageing times may be useful for practical reasons as set out above.

In circumstances where the seed crystals have MGDA $Na_3$ present as a blend of amorphous solid and MGDA $Na_3$ in dihydrate form, it will be evident to the skilled person that the minimum ageing period will be intermediate between that for MGDA $Na_3$ as amorphous solid and that for MGDA $Na_3$ as dihydrate.

Without wishing to be bound by any theory, it is thought that the minimum ageing period should provide sufficient time for the solid MGDA $Na_3$ initially present in the slurry to substantially convert to solid crystalline MGDA $Na_3$ dihydrate, to provide solid seed particles substantially of MGDA $Na_3$ dihydrate uniformly distributed throughout the resulting aged slurry, with the aged slurry spray dried in step (B). As explained hereinbefore, the MGDA $Na_3$ may be considered as substantially converted to solid crystalline MGDA $Na_3$ dihydrate when the MGDA $Na_3$ exhibits the crystal structure of the dihydrate form with a crystallinity in excess of 50% as measured by powder x-ray diffraction.

More specifically, when the seed particles of solid MGDA $Na_3$ are initially predominantly amorphous, longer ageing times, such as ageing times of 3 hours or longer are preferred, in combination with a slurry temperature of 60° C. or more. When the seed particles are initially of solid MGDA $Na_3$ predominantly in the dihydrate form, shorter ageing times may be used, in combination with lower slurry temperature, such as 20° C. or more. When the seed particles of solid MGDA $Na_3$ are initially a blend of amorphous and dihydrate, the ageing time and slurry temperature may be adjusted to ensure that the slurry, after ageing, has seed particles of MGDA $Na_3$ substantially present as the dihydrate, measured as set out hereinbefore, in order to ensure that the spray dried particles comprise MGDA $Na_3$ dihydrate, and to ensure that the resulting builder granules remain free flowing after 48 hours storage at 20° C. and 65% relative humidity In one arrangement of a process according to the first aspect of the invention, the slurry may be formed by blending a primary aqueous solution of MGDA $Na_3$ with sufficient added solid particles of MGDA $Na_3$ to provide an excess of solid particles over an amount required to saturate the aqueous solution with MGDA $Na_3$ at the slurry temperature, wherein the minimum ageing period is sufficient for MGDA $Na_3$ of the excess solid particles to be present as solid crystalline MGDA $Na_3$ dihydrate in the aged slurry. Preferably, the slurry is aged for sufficient time for the MGDA $Na_3$ of the excess solid particles to substantially convert to solid crystalline MGDA $Na_3$ dihydrate as measured by XRD, using the method as set out hereinbefore.

The sufficient added solid particles of MGDA $Na_3$ may be spray dried particles of solid amorphous MGDA $Na_3$ obtained by spray drying an aqueous solution of MGDA $Na_3$, for instance a saturated or near-saturated solution of MGDA $Na_3$.

Suitably, the amount of sufficient added solid particles is enough to provide from 3 to 15% by weight excess of MGDA $Na_3$ over the amount required to provide saturation of MGDA $Na_3$ in the aqueous solution of the slurry at the slurry temperature. This may be achieved by suitable proportioning of the ingredients when preparing the slurry, or may be achieved by reliance upon evaporative loss of water vapour from the slurry, when held at the slurry temperature, to concentrate the slurry.

The primary aqueous solution of MGDA $Na_3$ may have a concentration of from 35% to 55% by weight of MGDA $Na_3$, depending upon the temperature and presence of other optional ingredients in the primary aqueous solution. A typical concentration would be from 39 to 45% by weight of MGDA $Na_3$.

If the slurry temperature is below 20° C. during ageing, the reaction kinetics may be such that any phase changes giving rise to the technical effect of the invention do not occur sufficiently rapidly. At temperatures in excess of the boiling point of the slurry, energy may be wasted in supplying latent heat to cause water to boil from the slurry and so the upper temperature limit is effectively the boiling point of the slurry. In other words, the preferred temperature range for ageing is from 20° C. to the boiling point of the slurry, with 110° C. as a typical boiling point. Preferably, the slurry is at 60° C. to 90° C., for instance 70° C. to 90° C.

Without wishing to be bound by any theory, it is believed that the presence of solid seed particles of MGDA $Na_3$ dihydrate in the slurry, whilst the slurry is at a temperature in excess of 20° C. and below its boiling point, say 110° C., leads to a modification of the slurry which causes crystalline MGDA $Na_3$ dihydrate to be formed immediately upon spray drying of the slurry in a spray drying apparatus under non-agglomerating conditions. Surprisingly, this effect may also be achieved even when the solid seed particles comprising MGDA $Na_3$ are initially of an amorphous nature, with the proviso that the slurry is sufficiently aged, in the presence of the initially amorphous solid seed particles, prior to spray-drying.

When the solid seed particles are initially of MGDA $Na_3$ dihydrate, then the ageing time may be considerably reduced or may be effectively dispensed with, with the only time required being that needed to give distribution of solid seed particles though the slurry.

The solid seed particles are substantially uniformly distributed throughout the slurry following its preparation and during the ageing of the slurry. This may be achieved by any conventional processing technique such as the use of a stirred tank holding the slurry or, for instance the use of a recycling loop in combination with a tank holding the slurry used to pump slurry from the base of the tank to the top of the tank in order to maintain distribution of solid seed particles in a substantially uniform manner throughout slurry. Such techniques are well known in the art in order to prevent settling of seed particles which will typically be of a higher density than the aqueous solution in which their suspension is desired. The reason for this maintenance of uniform distribution of the solid seed particles throughout the slurry is to ensure that the settlement of the solid particles as a consolidated layer does not take place as this can lead to difficulties in cleaning the apparatus between batches and will also reduce the interfacial area over which interaction between the solid seed particles and the aqueous solution of the slurry can take place.

In one particularly useful arrangement of a process according to the first aspect of the invention:

i) a solution of MGDA $Na_3$ is spray-dried to form spray dried particles of solid amorphous MGDA $Na_3$, ii) a primary slurry is formed by blending a primary aqueous solution of MGDA $Na_3$ with sufficient of the spray dried particles of solid amorphous MGDA $Na_3$ to provide an excess over an amount required to saturate the aqueous solution with MGDA $Na_3$ at the slurry temperature, and aged by maintaining the primary slurry at a temperature of 20° C. or more, preferably 60° C. or more, for an ageing time of 1 hour or longer, preferably 2 hours or longer, more preferably 3 hours or longer and even more preferably 4 hours or longer, iii) the aged primary slurry is spray dried in accordance with step (B) of the first aspect of the invention, with the resulting spray dried particles comprising solid crystalline MGDA $Na_3$ dihydrate split into first and second portions, the first portion proceeding to process steps according to steps (C) and (D) the first aspect of the invention to form builder granules, iv) the second portion of spray dried particles comprising solid crystalline MGDA $Na_3$ dihydrate from step (iii) is used as seed particles in a process according to step (A) of the first aspect of the invention to form a secondary slurry comprising seed particles of crystalline MGDA $Na_3$ dihydrate dispersed in further primary aqueous solution of MGDA $Na_3$, and maintained at a slurry temperature of 20° C. or more for an ageing time of 5 seconds or longer, v) the secondary slurry is spray dried in accordance with step (B) of the first aspect of the invention, with the resulting spray dried particles comprising solid crystalline MGDA $Na_3$ dihydrate split into first and second portions, the first portion proceeding to process steps according to steps (C) and (D) of the first aspect of the invention to form the builder granules, vi) the second portion of spray dried particles from step (v), comprising solid crystalline MGDA $Na_3$ dihydrate, is used as seed particles in a process according to step (A) of the first aspect of the invention to form further secondary slurry comprising seed particles of crystalline MGDA $Na_3$ dihydrate dispersed in an aqueous solution of MGDA $Na_3$, and maintained at a slurry temperature of 20° C. or more for an ageing time of 5 seconds or longer, with the further secondary slurry then used to repeat step (v), and vii) steps (v) and (vi) are iterated as required as a batch, semi-continuous or continuous process to form further builder granules.

The solution used in step (i) of this arrangement may be a commercial solution of MGDA $Na_3$ with a concentration of say from 39% to 45% by weight of MGDA $Na_3$. The solution may be at a temperature from 20° C. to its boiling point (say 110° C.) when spray dried, for instance from 60° C. to 90° C. The spray drying is suitably carried out using the same non-agglomerating conditions as already set out hereinbefore for the first aspect of the invention, with an air inlet temperature for the spray dryer from 150° C. to 350° C., to form spray dried particles with at least 90% by weight of the spray dried particles having a diameter less than 300 μm. The resulting particles will be of MGDA $Na_3$ in a solid amorphous state. These particles are then blended with a primary aqueous solution of MGDA $Na_3$ to form a primary slurry, with enough of the solid amorphous spray dried particles added to provide an excess over an amount required to saturate the primary aqueous solution with MGDA $Na_3$.

The primary slurry is then aged at a temperature of 20° C. or more for an ageing time of 1 hour or longer preferably in 2 hours or longer. A preferred ageing time is 3 hours or longer, more preferably in 4 hours or longer as set out hereinbefore, particularly with a slurry temperature from 60° C. to 90° C. This is thought to ensure adequate formation of the dihydrate crystal for the solid MGDA $Na_3$ seed particles.

In step (iii) of this arrangement, the aged primary slurry is spray dried in accordance with step (B) of the first aspect of the invention, with the resulting spray dried particles comprising solid crystalline MGDA $Na_3$ as dihydrate. The resulting spray dried particles are split into first and second portions, the first portion proceeding to process steps according to steps (C) and (D) of the first aspect of the invention in order to form builder granules. The second portion of spray dried particles from step (iii) is used as seed particles in a process according step (A) of the first aspect of the invention. In other words, the second portion is added to further primary aqueous solution of MGDA $Na_3$ in order to form a secondary slurry, and the secondary slurry is maintained at a slurry temperature of 20° C. or more, preferably 60° C. to 90° C. for an ageing time of 5 seconds or longer. In other words, only minimal ageing or substantially no ageing is required for this secondary slurry prior to spray drying.

The secondary slurry is spray dried in accordance with step (B) of the first aspect of the invention, with the resulting spray dried particles comprising solid crystalline MGDA $Na_3$ dihydrate, which is again split into first and second portions, the first portion proceeding to process steps according to steps (C) and (D) of the first aspect of the invention to form the builder granules. The second portion of spray dried particles from step (v), is used as seed particles to form further secondary slurry, in accordance with step (A) of the first aspect of the invention, and maintained at a slurry temperature of 20° C. or more for an ageing time in excess of 5 seconds (i.e. minimal ageing prior to spray-drying).

The further secondary slurry is then used to repeat step (v), and steps (v) and (vi) are repeated or iterated.

This iteration may be carried out in a repeated batch process, in a semi-continuous manner or as a continuous process. Typically, if the primary aqueous solution used in the process has a concentration of about 43% by weight of MGDA, then the first and second portions, into which the spray dried particles comprising MGDA $Na_3$ dihydrate are split, may be in the ratio of about 60:40 by weight. In other words, about 40% by weight of the seed particles are recycled in the continuous or semi-continuous process, to form further secondary slurry for spray drying, by blending the seed particles with further primary aqueous solution, with about 60% of the spray dried particles proceeding on to steps (C) and (D) of the process of the first aspect of the invention to be formed into builder granules.

It will be understood that if the primary aqueous solution has a higher initial concentration of MGDA $Na_3$ than 43% by weight, for instance say 48% by weight, then the weight ratio of first to second portions may be higher than 60:40, say 70:30. The primary aqueous solution of MGDA $Na_3$ may have a concentration of from 35% to 55% by weight of MGDA $Na_3$. The MGDA $Na_3$ concentrations of the primary aqueous solutions used in steps (ii), (iv) and (vi) may be different to each other, but for simplicity of operation are preferably the same as each other. Also, the same concentration of aqueous solution may be used in step (i).

Put simply, this arrangement of the process involves:

A start-up process with: — initial formation of amorphous MGDA $Na_3$ spray dried particles, using the amorphous spray dried particles as seeds to form spray dried particles comprising MGDA $Na_3$ in dihydrate form (by adequate ageing prior to spray drying), and A continuous/semi continuous process with: — the spray dried dihydrate particles from the start-up process used as seed particles in a continuous or semi-continuous process with a first portion of spray dried particles used to form builder granules and a second portion fed back to form slurry, by blending with further aqueous MGDA $Na_3$ solution, for further spray drying.

In another useful arrangement of a process according to the first aspect of the invention, the start-up process of (i) spray drying a solution of MGDA $Na_3$ to form spray dried particles of solid amorphous MGDA $Na_3$, and (ii) forming a primary slurry by blending a primary aqueous solution of MGDA $Na_3$ with sufficient of the spray dried particles of solid amorphous MGDA $Na_3$ to provide an excess over an amount required to saturate the aqueous solution with MGDA $Na_3$ at the slurry temperature, and maintaining the primary slurry at a temperature of 20° C. or more for an ageing time of 1 hour or longer, preferably 2 hours or longer, more preferably 3 hours or longer and even more preferably 4 hours or longer may be replaced by the following:

(x) Forming a primary slurry by blending a primary aqueous solution of MGDA $Na_3$ with sufficient particles of solid amorphous MGDA $Na_3$ to provide an excess over an amount required to saturate the aqueous solution with MGDA $Na_3$ at the slurry temperature, and maintaining the primary slurry at a temperature of 20° C. or more, preferably 60° C. or more, for an ageing time of 1 hour or longer, preferably 2 hours or longer, more preferably 3 hours or longer and even more preferably 4 hours or longer.

The solid amorphous MGDA $Na_3$ particles may, for instance, be commercially available solid amorphous MGDA $Na_3$ particles in powder or granule form, such as Trilon™ M powder or Trilon™ M compactate.

Hence, step (x) may replace steps (i) and (ii) in the arrangement set out above to provide the following process according to the invention, with step (x) as step (i) in the following paragraph, and the other steps renumbered accordingly.

i) a primary slurry is formed by blending a primary aqueous solution of MGDA $Na_3$ with sufficient particles of solid amorphous MGDA $Na_3$ to provide an excess over an amount required to saturate the aqueous solution with MGDA $Na_3$ at the slurry temperature, and aged by maintaining the primary slurry at a temperature of 60° C. or more for an ageing time of 3 hours or longer, ii) the aged primary slurry is spray dried in accordance with step (B) of the first aspect of the invention, with the resulting spray dried particles comprising solid crystalline MGDA $Na_3$ dihydrate split into first and second portions, the first portion proceeding to process steps according to steps (C) and (D) of the first aspect of the invention to form builder granules, iii) the second portion of spray dried particles comprising solid crystalline MGDA $Na_3$ dihydrate from step (ii) is used as seed particles in a process according step (A) of the first aspect of the invention to form a secondary slurry comprising seed particles of crystalline MGDA $Na_3$ dihydrate dispersed in further primary aqueous solution of MGDA $Na_3$, and maintained at a slurry temperature of 20° C. or more for an ageing time of 5 seconds or longer, iv) the secondary slurry is spray dried in accordance with step (B) of the first aspect of the invention, with the resulting spray dried particles comprising solid crystalline MGDA $Na_3$ dihydrate split into first and second portions, the first portion proceeding to process steps according to steps (C) and (D) of the first aspect of the invention to form the builder granules, v) the second portion of spray dried particles from step (iv), comprising solid crystalline MGDA $Na_3$ dihydrate, is used as seed particles in a process according step (A) of the first aspect of the invention to form further secondary slurry comprising seed particles of crystalline MGDA $Na_3$ dihydrate dispersed in an aqueous solution of MGDA $Na_3$, and maintained at a slurry temperature of 20° C. or more for an ageing time of 5 seconds or longer, with the further secondary slurry then used to repeat step (iv), and vi) steps (iv) and (v) are iterated as required as a batch, semi-continuous or continuous process loop to form further builder granules.

The slurry for use in the process of the first aspect of the invention may further comprise alkali metal silicate having a molar ratio of $SiO_2/M_2O$ from 1.0 to 3.5, wherein R, the weight ratio of MGDA.$Na_3$/alkaline silicate in the slurry, is 3.5 or more, and wherein M is an alkali metal.

The term alkali metal silicate is used to refer to a compound comprising $SiO_2$ and $M_2O$, having a molar ratio from 1.0 to 3.5, wherein M is an alkali metal, preferably potassium and/or sodium, more preferably sodium. Such compounds are also referred to in the art as alkaline silicate, such as sodium silicate or potassium silicate. Such silicates are soluble in water and are generally manufactured by digestion of silica sand in an aqueous alkaline medium such as NaOH or KOH solution or by dissolving silicate glass, made from the fusion of sand and soda ash or potash, in water.

Preferably the alkaline silicate for use in the first aspect of the invention has a molar ratio of $SiO_2/M_2O$ from 1.6 to 2.6.

Suitably, the alkali metal silicate molar ratio $SiO_2/M_2O$ is less than (1+R/9) wherein R, the weight ratio of MGDA salt/alkali metal silicate in the slurry, is 3.5 or more. It has been found that higher molar ratios for the alkali metal silicate may lead to phase separation within the slurry during the ageing of the slurry prior to spray drying. The use of a molar ratio less than (1+R/9) leads to avoidance of viscous silicate solutions adhering to vessel walls so cleaning and reuse of the processing apparatus is facilitated.

It has been found that the incorporation of alkali metal silicate, as set out above, in the builder granules of the invention, provides reduction in risk of explosion hazard and self-heating for the builder granules. At the levels introduced, there is no substantial reduction in building performance nor is there any substantial increase in the hygroscopicity or reduction in the caking resistance of the builder granules of the invention.

A second aspect of the invention provides builder granules suitable for use in a granular detergent composition or detergent tablet obtained or obtainable by a process according to the first aspect of the invention.

A third aspect of the invention provides builder granules suitable for use in a granular detergent composition or detergent tablet comprising from 5 to 15% by weight of water, from 50 to 90% by weight of MGDA $Na_3$ salt and from 5 to 20% by weight of alkali metal silicate having a molar ratio of $SiO_2/M_2O$ from 1.0 to 3.5, wherein M is an alkali metal and wherein R, the weight ratio of MGDA salt/alkaline silicate in the builder granules, is 3.5 or more, and wherein MGDA $Na_3$ salt is present as solid crystalline MGDA $Na_3$ dihydrate in the builder granules.

Preferably, the MGDA $Na_3$ salt is substantially present as crystalline MGDA $Na_3$ dihydrate (for instance, the MGDA $Na_3$ in the builder granules exhibits the crystal structure of the dihydrate form with a crystallinity in excess of 50% as measured by powder x-ray diffraction—XRD—as set out hereinbefore).

Preferably, the granules consist essentially of from 5 to 15% by weight of water, from 60 to 90% by weight of MGDA $Na_3$ salt and from 5 to 20% by weight of alkali metal silicate.

If impurities is present from the commercial source of MGDA $Na_3$, these will also be present in the granules of the third aspect of the invention, so that the upper limit for MGDA $Na_3$ may be practically reduced to say 84% instead of 90%, but substantially pure MGDA $Na_3$ may be used as a starting material to avoid this.

The alkali metal silicate is suitably selected from the group consisting of sodium silicate, potassium silicate and mixtures thereof, preferably sodium silicate.

The builder granules, yielded by the process of the first aspect of the invention, have a low tendency to cake after moisture uptake arising from hygroscopicity, and so can be incorporated into granular detergent compositions or detergent tablets, such as machine dishwash compositions or tablets, without substantial degradation of flow or stickiness for the resulting granular compositions and without substantial reduction in friability or disintegration for resulting tabletted compositions. Sticky builder granules incorporated into tablets may lead to difficulties in disintegration of the tablets in use.

It is thought that the low tendency of the builder granules of the invention to resist caking following water uptake (i.e. hygroscopicity) is linked to the presence of significant quantities of MGDA $Na_3$ dihydrate in the builder granules, and that this in turn arises from the use of seed particles including MGDA $Na_3$ dihydrate when forming the slurry for spray drying, or from the adequate ageing of the slurry when MGDA solid other than the dihydrate crystalline form is used as seed particles. It is believed that the adequate ageing of the slurry is required to ensure that the aged slurry includes a substantial proportion of seed particles of MGDA $Na_3$ containing MGDA $Na_3$ dihydrate.

EXAMPLES

Figure 2:
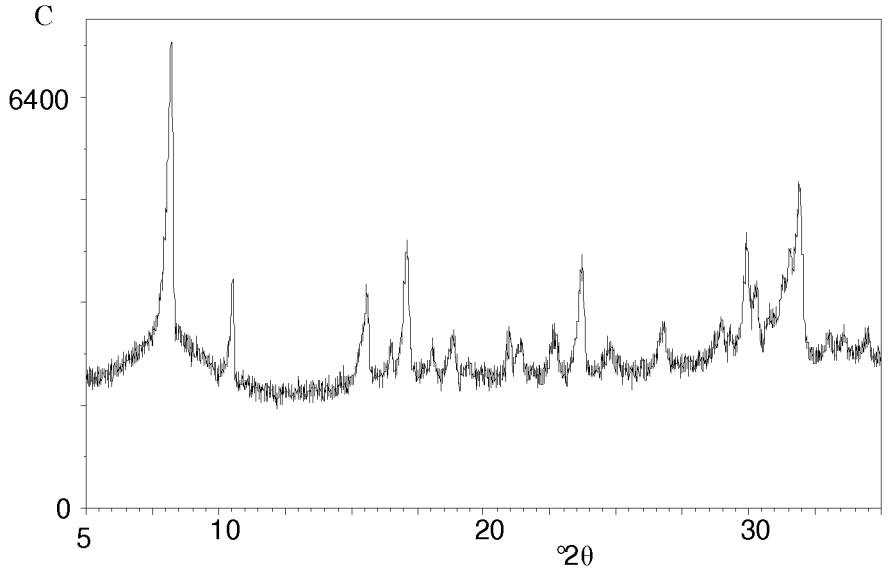
Figure 3:
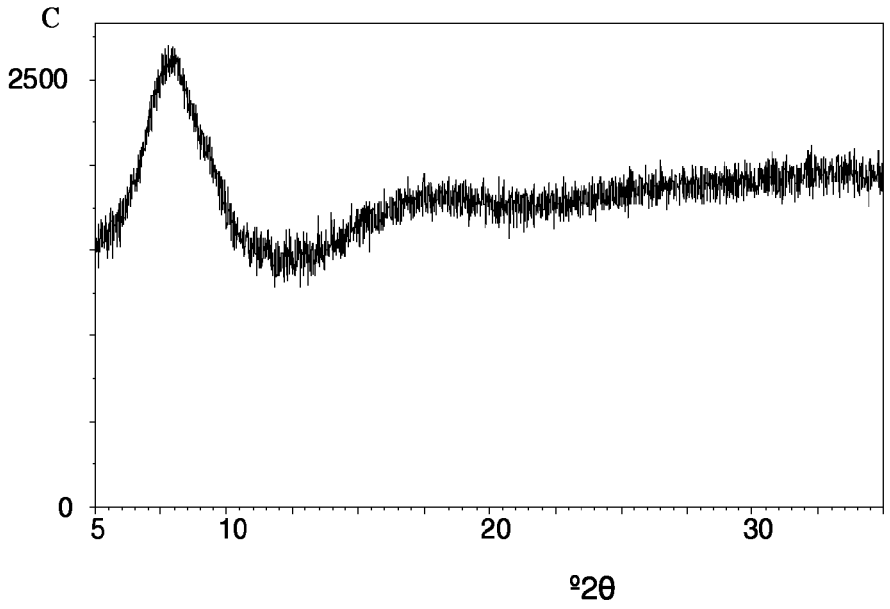
Figure 4:
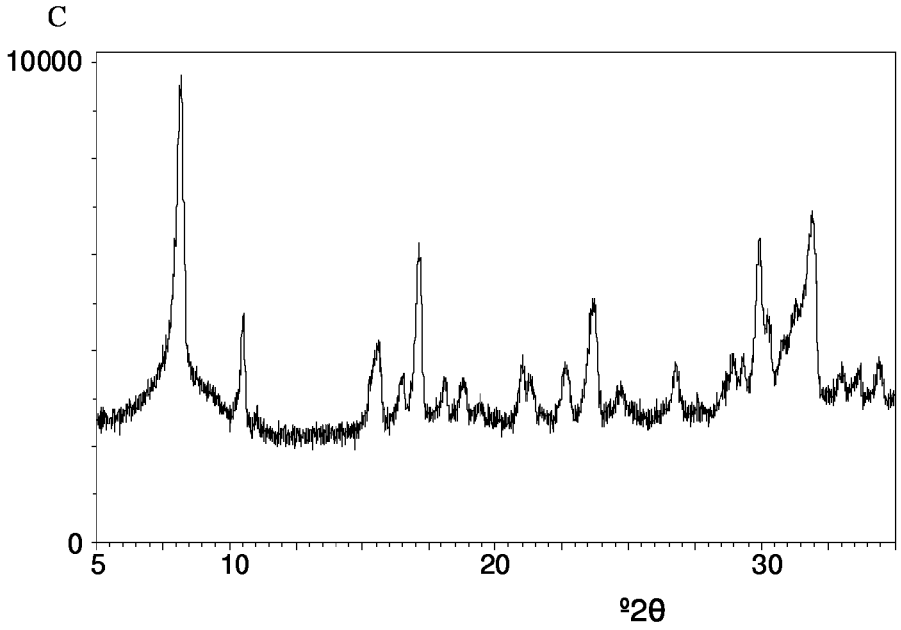
Figure 5:
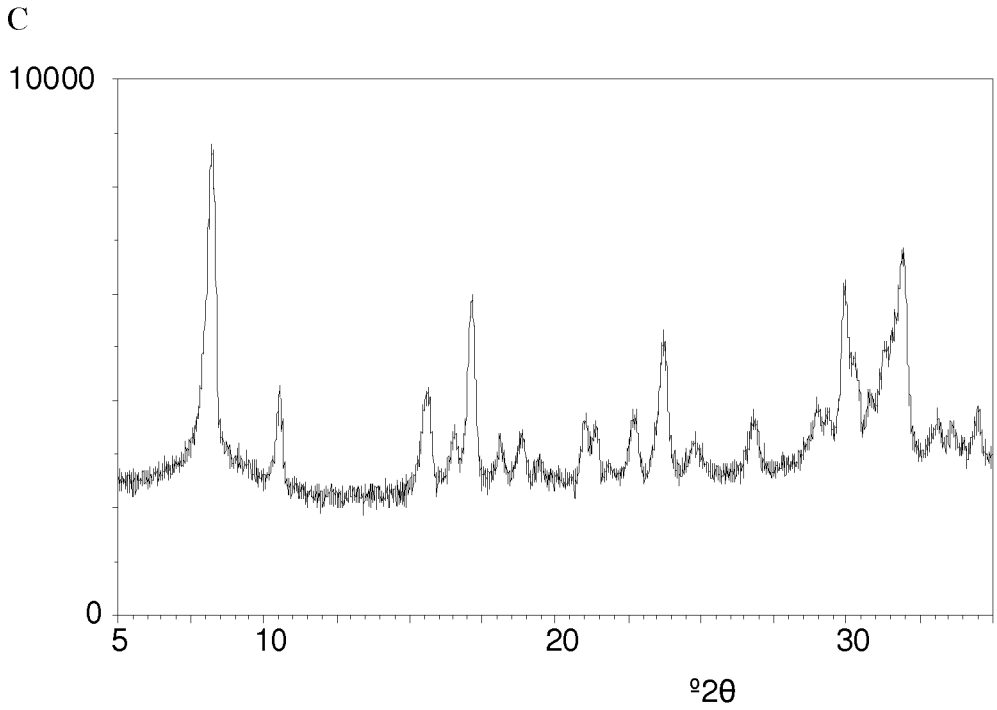
Figure 6:
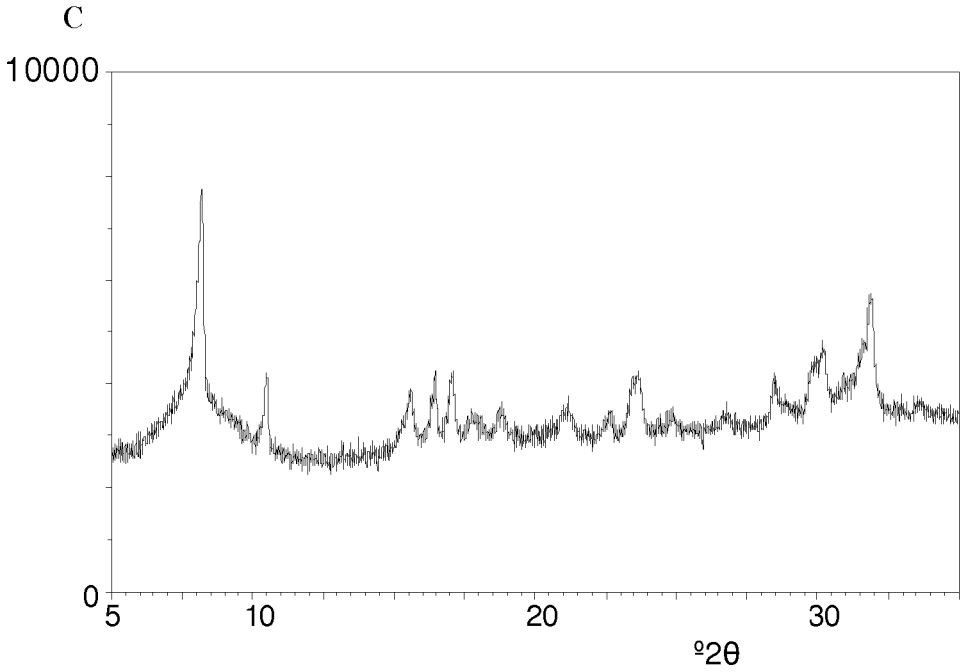
Figure 7:
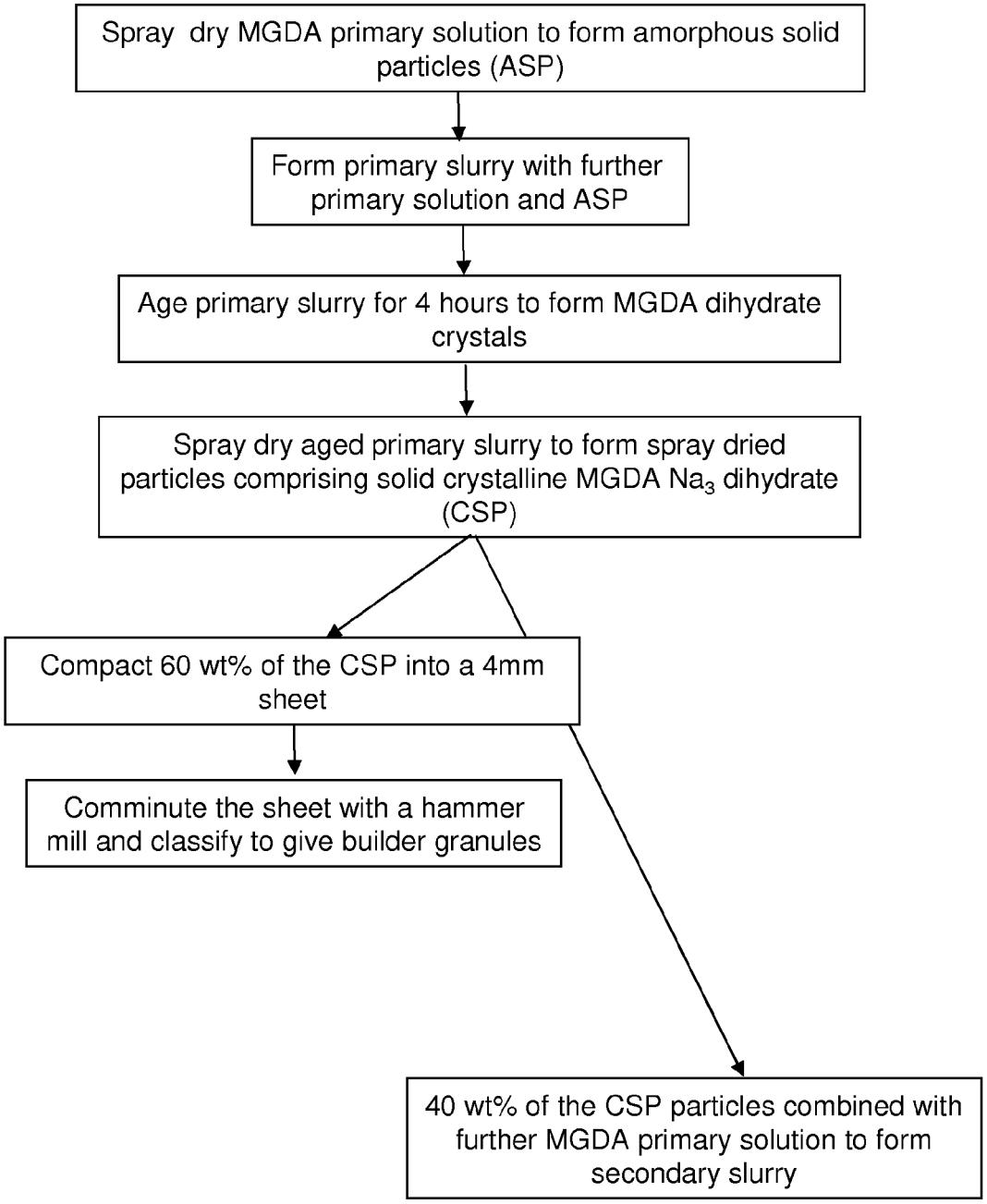
Figure 8:
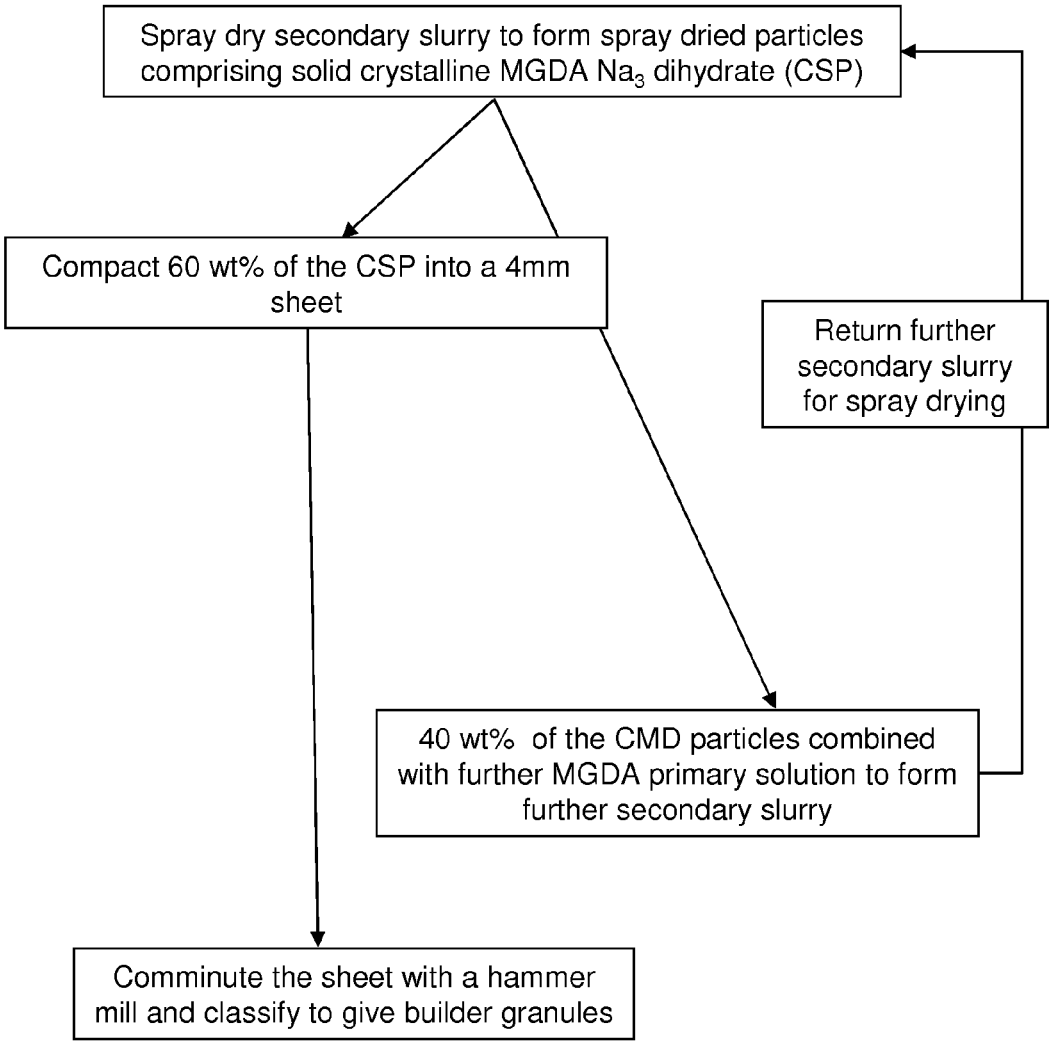

Specific embodiments of the present invention will now be described, by way of example only with reference to the accompanying drawings in which:

FIG. 1 shows the powder x-ray diffraction pattern for granules prepared according to comparative Example 1, FIG. 2 shows the powder x-ray diffraction pattern for granules prepared according to Example 2 (according to the invention), FIG. 3 shows the powder x-ray diffraction pattern for granules prepared according to comparative Example 3, FIG. 4 shows the powder x-ray diffraction pattern for granules prepared according to Example 4 (according to the invention), FIG. 5 shows the powder x-ray diffraction pattern for the initial crystalline seed particles prepared by the 2-stage start-up process of Example 5 (according to the invention), FIG. 6 shows the powder x-ray diffraction pattern for the final spray dried powder prepared by the continuous process of Example 5 (according to the invention) after continuous operation for 1 hour, FIG. 7 shows a schematic flow chart for a start-up process prior to initiation of a continuous process according to the first aspect of the invention, and FIG. 8 shows a schematic flow chart for a continuous process according to the first aspect of the invention.

For each of the figures, the ordinate shows 20 measured in degrees, and the abscissa shows counts per second (C) as an indication of x-ray intensity.

For all examples set out below, the MGDA salt used as the starting material was a commercially available sodium MGDA salt solution (MGDA $Na_3$— Trilon™ M Liquid ex BASF, 40% by weight MGDA $Na_3$ salt by the supplier, containing 40% by weight of the MGDA $Na_3$ salt and 3% by weight impurities. Hence the purity of the MGDA $Na_3$ salt, expressed as percentage by weight of dry matter (excluding water completely) was 93.02%

Powder x-ray diffraction patterns for the following Examples were obtained using a Philips PW3830 x-ray generator (Cu-K α-radiation) and PW3020 goniometer from PANalytical NV.

Example 1

Example 1 is a comparative example.

For this example, the MGDA $Na_3$ solution was blended with sodium silicate solution having a molar ratio (MR) $SiO_2/Na_2O$ of 2.05 as follows:

| | |
|---|---|
| MGDA $Na_3$ solution | 7003.1 kg |
| Sodium silicate solution (53.1% solids, molar ratio MR 2.05) | 1241.5 kg |
| Water | 223.5 kg |

The mixture was blended with the water and MGDA solution at room temperature, and the silicate solution at 80° C. is added to form a clear homogeneous liquid with all components in solution. The total solids content of the solution was 43.35% by weight The resulting liquid was heated to 85° C. and spray-dried in a co-current spray-drying tower using an air inlet temperature of 230° C. and an air outlet temperature of 114° C. to provide amorphous solid spray-dried particles having a moisture content of 12.6% by weight based on chemical analysis (this moisture content thus includes any water present in hydrated solid MGDA). A rotating disc atomizer was used for slurry droplet formation in the dryer, using tip speed of 128 $m \cdot s^{-1}$.

The resulting spray-dried powder was amorphous (i.e. no sharp crystalline peaks were observed in the x-ray powder diffraction pattern for the spray-dried powder as shown in FIG. 1). The spray dried powder had at least 90% by weight of particles less than 250 μm in diameter as measured by air sieving.

The spray-dried powder was compacted into compacted aggregates using a roller compactor from Alexanderwerke (the apparatus having two rollers with a 4 mm nip gap into which the spray dried powder was fed using a twin-screw feed, then compacted into a sheet) and subsequently comminuted and classified by sieving to form builder granules consisting essentially of MGDA $Na_3$ salt, sodium silicate and water with particle size from 200 and 1400 μm.

The granules were stored in a 10 cm internal diameter Petri dish (10 g sample giving a layer about 1-3 mm thick) as a granular, uncompacted bed at 20° C. and 65% relative humidity. This resulted in the bed of granules solidifying as a cohesive mass within 24 hours, demonstrating unacceptable hygroscopicity and unacceptable storage behaviour.

Example 2

Example 2 is according to the invention.

A solution was prepared by mixing the commercial MGDA salt solution as described above for Example 1 with water and the sodium silicate solution as described in example 1 in addition to caustic soda solution (50% by weight NaOH in water). The caustic soda solution was added to reduce the molar ratio of the sodium silicate from the value of 2.05 used in example 1 to a value of 1.70.

The mixture was prepared at room temperature and formed a clear homogeneous liquid with all of the ingredients dissolved therein. Solid seed particles were then blended into the homogeneous liquid, the solid seed particles being the spray dried particles produced in Example 1. The resulting slurry had the following composition:

| | |
|---|---|
| MGDA $Na_3$ solution | 56.850 kg |
| Water | 4.044 kg |
| Caustic soda (NaOH) solution (50% by weight NaOH) | 1.239 kg |
| Sodium silicate (53.1% by weight solids, MR 2.05) | 2.995 kg |
| Spray-dried powder from example 1 | 34.924 kg |

The resulting slurry had an overall solids content of 57.0% by weight, with the total MGDA content expressed as MGDA $Na_3$ being 46% by weight. The slurry was heated to 80° C. and allowed to age, whilst being stirred in order to maintain any dissolved solids substantially suspended uniformly throughout the slurry, for 13 hours. The aged slurry resulting from this treatment was found to contain suspended solids which remained undissolved in the aqueous solution part of the slurry. The mixture was then spray-dried using an air inlet temperature of 200° C. and an air outlet temperature of 100° C. to generate a spray dried powder having a moisture content of approximately 10% by weight based on chemical analysis.

As shown in FIG. 2, the resulting spray-dried powder showed clear evidence of substantial MGDA $Na_3$ dihydrate crystalline structure from the x-ray powder diffraction spectrum. The spray dried powder was compacted into compacted aggregates using the same roller compactor as in Example 1 and the resulting compacted aggregates comminuted to form builder granules, classified by sieving to provide a particle sizes from 200 and 1400 μm.

The resulting granules were stored in a 10 cm internal diameter Petri dish (10 g sample giving a layer about 0.5 to 3 mm thick) as a granular, uncompacted bed at 20° C. and 65% relative humidity. After 3 days of storage, the bed only showed slight caking behaviour, with the granules easily returned to a mobile, free-flowing state by gentle shaking.

Example 3

Example 3 is a comparative example.

A spray dried powder was prepared by spray-drying the commercially available MGDA salt solution as described for example 1. For this Example, no sodium silicate was added to the commercial solution and the liquid used for spray-drying was simply the commercial solution itself, first heated to 80° C. and spray-dried using air inlet and outlet temperatures of 200° C. and 100° C. respectively.

The resulting spray-dried powder had a moisture content of 7.3% by weight measured by chemical analysis, hence the MGDA $Na_3$ content was 86.23% with the remainder of solids being impurities from the commercial MGDA used as starting material. The spray-dried particles exhibited an x-ray powder diffraction pattern as shown in FIG. 3, demonstrating that the MGDA salt was in an amorphous state as no sharp crystalline diffraction peaks were visible.

The spray-dried particles had at least 90% by weight less than 250 μm in diameter as measured by air sieving Example 4

Example 4 is according to the first aspect of the invention, but without sodium silicate present.

A slurry was prepared by combining the commercially available MGDA solution as described for example 1, with the spray dried powder from Example 3 as solid seed particles. The resulting slurry had the following composition:

| | |
|---|---|
| MGDA solution | 54.996 kg |
| Spray-dried powder | 20.793 kg |

The slurry was heated to a temperature of 80° C. and allowed to remain 80° C. for 3 hours whilst being stirred to maintain the solid seed particles uniformly dispersed throughout the slurry. The dry solids content of the mixture was 56.6% by weight, with 52.7% of the dry solids being MGDA $Na_3$. At this concentration, the solid seed particles did not dissolve entirely in the aqueous solution part of the slurry.

The slurry was subsequently spray-dried using an air inlet temperature of 200° C. and an air outlet temperature of 100° C. The resulting spray-dried powder had a moisture content of 8.55% based on chemical analysis (hence MGDA $Na_3$ content was 85.07%). The x-ray powder diffraction pattern, as shown in FIG. 4, demonstrated that the spray-dried powder contained substantial amounts of solid crystalline MGDA $Na_3$ dihydrate as evidenced by the diffraction peaks. The powder was compacted into aggregates which were subsequently comminuted and classified to form builder granules with particle size from 200 to 1400 μm. The granules resulting from this process were stored as an uncompacted granular bed at 20° C. and 65% relative humidity as explained above. After 3 days storage under these conditions, the granules had not caked and were completely free-flowing.

Example 5

Example 5 is according to the invention.

First, a spray dried powder was prepared following the steps two-stage process route as set out above for Example 2, but with the composition modified, compared to that of Example 2, to give a final spray dried powder with a weight ratio of MGDA $Na_3$:sodium silicate of 14.8:1.

For the first stage of this initial 2-stage start-up process, spray drying was carried out using the following primary aqueous solution:

| | |
|---|---|
| MGDA $Na_3$ solution | 76.802 kg |
| Sodium silicate solution (53.1% solids, molar ratio MR 2.05) | 4.291 kg |

[The weight ratio of MGDA $Na_3$:sodium silicate was 14.8:1].

The resulting spray dried particles were solid amorphous MGDA $Na_3$ and exhibited an XRD pattern similar to that shown in FIG. 1.

The second stage of this initial 2-stage start-up process was to blend the spray dried solid amorphous particles from the first stage with further primary aqueous solution. The slurry that was produced had an overall solids content of 57.0% by weight. The slurry was heated to 80° C. and allowed to age, whilst being stirred in order to maintain any dissolved solids substantially suspended uniformly throughout the slurry, for 13 hours. The aged slurry resulting from this treatment was found to contain suspended solids which remained undissolved in the aqueous solution part of the slurry. This aged slurry was then spray dried using air inlet and outlet temperatures of 200° C. and 100° C. respectively, to produce a spray dried powder having a moisture content of 11.4%. The resulting spray dried powder, referred to below as "crystalline seed powder", exhibited an XRD pattern as shown in FIG. 5, demonstrating that the crystalline seed powder resulting from the 2-stage start-up process was predominantly MGDA $Na_3$ dihydrate.

The crystalline seed powder was then used to initiate a continuous process as follows:

Further primary aqueous solution was prepared, as described above, and heated to 85° C. in order to form a clear homogeneous liquid with all of the ingredients dissolved therein. This primary aqueous solution was dosed into a mixing vessel at 7.9 kg/hour along with the crystalline seed powder from the start-up stage of this Example, dosed into the vessel at the rate of 3.18 kg/hour in order to form a slurry.

Vigorous mixing took place inside the mixing vessel to homogenise the resulting slurry which was kept at a slurry temperature between 65° C. and 70° C. and had a solids concentration of 56.5%. At this concentration, some of the solids remained undissolved and the mixture remained as a liquid slurry which contained suspended dispersed solids of the crystalline seed particles.

In the mixing vessel, an amount of about 1.3 kg of this slurry was maintained by feeding the slurry out from the vessel into a co-current spray drying tower at the same rate as further liquid and crystalline seed powder were dosed together into the mixing vessel (giving an average residence time in the mixing vessel, for the slurry, of about 7 min). Inlet and outlet air temperatures of the spray drier were 177° C. and 96° C. respectively. After about 1 hour of spray drying, the powder collected from the base of the tower was proportioned and 40% by weight was fed into the mixing vessel to be blended with the primary aqueous solution, replacing the original crystalline seed powder used to initiate the continuous stage of the process of this Example.

Operation of the continuous process using the recycled, spray-dried powder was carried out for about 1 hour with about 40% of the powder collected from the spray drier recycled back to form slurry and the remaining 60% used to subsequently form builder granules in its turn to produce the mixture in the mixing vessel. In this way, spray dried powder was effectively recycled back through the system 11 times.

The final spray dried powder produced had an XRD-spectrum as depicted in FIG. 6, showing again the crystalline structure of the MGDA $Na_3$ dihydrate form as predominant.

This spray dried powder was subsequently compacted into builder granules and these were subjected to storage under the same standard conditions as set out above. After 3 days storage, the builder granules only exhibited mild caking behaviour, and were easily free-flowing when subjected to gentle shaking to loosen the granules. The granules were still separate and remained as individual granules in the dish.

Example 6

FIGS. 7 and 8 provide a schematic flow diagram for the start-up of a continuous process according to the first aspect of the invention (FIG. 7) with the continuous process operation after start-up depicted in FIG. 8. In the start-up part of the process, shown in FIG. 7, primary solution having an MGDA $Na_3$ content of 43% by weight (commercial Trilon™ M solution) was spray dried to form amorphous solid particles (ASP) using a spray dryer with 220° C. air inlet temperature, with the primary solution at 70° C. prior to spray drying, using a 3 mm nozzle as droplet generator.

The resulting spray dried particles had a median particle size of about 40 μm with at least 90% by weight less than 200 μm as measured by air sieving. A primary slurry was formed by blending the ASP with further primary solution in suitable proportions so that the slurry had a total solids content of about 57% (53% MGDA $Na_3$) by weight.

The primary slurry was spray dried using a spray dryer with 220° C. air inlet temperature, with the primary slurry aged for 4 hours at 70° C. prior to spray drying, using a 3 mm nozzle as droplet generator. The resulting spray dried particles again had a median particle size of about 40 μm with at least 90% by weight less than 200 μm as measured by air sieving. XRD analysis showed that the resulting spray dried particles were crystalline solid particles with MGDA $Na_3$ substantially in the dihydrate state (CSP=crystalline solid particles). 60% by weight of the CSP were compacted into a 3 mm sheet using an Alexanderwerke roller compactor, with the resulting sheet comminuted in a hammer mill and the resulting granules classified to give builder granules having particle sizes from 200 to 1400 μm. The remaining 40% by weight of the CSP were combined with further primary solution of MGDA $Na_3$ to provide a secondary slurry having a total solids content of about 57% (53% MGDA $Na_3$) by weight.

Turning to the continuous process operation set out in FIG. 8, the secondary slurry from the start-up stage shown in FIG. 7 is spray dried using a spray dryer with 220° C. air inlet temperature, using a 3 mm nozzle as droplet generator. The secondary slurry was mixed for 7 minutes at 70° C. prior to spray drying (i.e. minimal ageing). The resulting spray dried particles were again particles having a median particle size of about 40 μm with at least 90% by weight less than 200 μm as measured by air sieving. XRD analysis showed that the resulting spray dried particles were crystalline solid particles (CSP) with MGDA $Na_3$ substantially in the dihydrate state.

60% by weight of the CSP progressed for compaction into a 3 mm sheet using an Alexanderwerke roller compactor, with the resulting sheet comminuted in a hammer mill and the resulting granules classified to give builder granules having particle sizes from 200 to 1400 μm. The remaining 40% by weight of the CSP were recycled for combination with further primary solution of MGDA $Na_3$ to provide further secondary slurry, having a total solids content of about 57% (53% MGDA $Na_3$) by weight.

The process steps as shown in FIG. 8 were operated in a continuous manner with the secondary slurry formed continuously from recycled CSP and primary aqueous solution of MGDA $Na_3$ and the spray drying of the slurry proceeding continuously with 60 wt % of the CSP proceeding on for compaction, comminution and classification into builder granules and 40 wt % of the CSP recycled to form further secondary slurry for spray drying. Undersize material from the classification step of the builder granule formation may be recycled to the roller-compacter to join the CSP as inlet material for compaction, with oversize recycled to the hammer mill for further comminution.

It will be appreciated that numerous modifications to the above described embodiments may be made without departing from the scope of the invention, as defined in the appended claims.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

We claim:

1. A process for preparing builder granules suitable for use in a granular detergent composition or detergent tablet, the process comprising:

A) forming a slurry comprising seed particles of solid MGDA $Na_3$ dispersed in an aqueous solution of MGDA $Na_3$, wherein the slurry further comprises alkali metal silicate having a molar ratio of $SiO_2/M_2O$ from 1.0 to 3.5, and wherein R, the weight ratio of MGDA.$Na_3$/alkaline silicate in the slurry, is 3.5 or more, and wherein M is an alkali metal, B) spray drying the slurry in a spray dryer, under non-agglomerating conditions, with a slurry temperature of 20° C. or more and an inlet temperature for drying air from 150° C. to 350° C., to form spray dried particles comprising solid crystalline MGDA $Na_3$ dihydrate, with at least 90% by weight of the spray dried particles having a diameter less than 300 μm, C) compacting the spray dried particles into compacted aggregates, D) comminuting the compacted aggregates into granular particles to form builder granules having a particle size distribution suitable for use in a granular detergent composition, wherein the slurry is maintained at the slurry temperature for an ageing time of at least a minimum ageing period to form an aged slurry prior to spray drying, the minimum ageing period being sufficiently long for the resulting builder granules to remain free flowing after 48 hours storage at 20° C. and 65% relative humidity.

2. The process of claim 1 wherein MGDA $Na_3$ in the resulting spray dried particles is present as solid crystalline MGDA $Na_3$ dihydrate.

3. The process of claim 1 wherein the aged slurry comprises from 3% to 15% by weight of seed particles at the slurry temperature.

4. The process of claim 1 wherein the seed particles in the aged slurry comprise MGDA $Na_3$ present as MGDA $Na_3$ dihydrate.

5. The process of claim 1 wherein the slurry is formed by blending a primary aqueous solution of MGDA $Na_3$ with sufficient added solid particles of MGDA $Na_3$ to provide an excess of solid particles over an amount required to saturate the primary aqueous solution with MGDA $Na_3$ at the slurry temperature, and wherein the minimum ageing period is sufficient for MGDA $Na_3$ of the excess solid particles to be present as solid crystalline MGDA $Na_3$ dihydrate in the aged slurry.

6. The process of claim 5 wherein the sufficient added solid particles of MGDA $Na_3$ are particles of solid amorphous MGDA $Na_3$, wherein the slurry temperature is 60° C. or more and wherein the minimum ageing period is 3 hours.

7. The process of claim 5 wherein the sufficient added solid particles of MGDA $Na_3$ are particles of MGDA $Na_3$ dihydrate, and wherein the minimum ageing period is 5 seconds.

8. The process of claim 5 wherein:

i) a solution of MGDA $Na_3$ is spray-dried to form spray dried particles of solid amorphous MGDA $Na_3$, ii) a primary slurry is formed by blending a primary aqueous solution of MGDA $Na_3$ with sufficient of the spray dried particles of solid amorphous MGDA $Na_3$ to provide an excess over an amount required to saturate the aqueous solution with MGDA $Na_3$ at the slurry temperature, and aged by maintaining the primary slurry at a temperature of 60° C. or more for an ageing time of 3 hours or longer, iii) the aged primary slurry is spray dried in accordance with step (B) of claim 1, with the resulting spray dried particles comprising solid crystalline MGDA $Na_3$ dihydrate split into first and second portions, the first portion proceeding to process steps according to steps (C) and (D) of claim 1 to form builder granules, iv) the second portion of spray dried particles comprising solid crystalline MGDA $Na_3$ dihydrate from step (iii) is used as seed particles in a process according step (A) of claim 1 to form a secondary slurry comprising seed particles of crystalline MGDA $Na_3$ dihydrate dispersed in further primary aqueous solution of MGDA $Na_3$, and maintained at a slurry temperature of 20° C. or more for an ageing time of 5 seconds or longer, v) the secondary slurry is spray dried in accordance with step (B) of claim 1, with the resulting spray dried particles comprising solid crystalline MGDA $Na_3$ dihydrate split into first and second portions, the first portion proceeding to process steps according to steps (C) and (D) of claim 1 to form the builder granules, vi) the second portion of spray dried particles from step (v), comprising solid crystalline MGDA $Na_3$ dihydrate, is used as seed particles in a process according step (A) of claim 1 to form further secondary slurry comprising seed particles of crystalline MGDA $Na_3$ dihydrate dispersed in an aqueous solution of MGDA $Na_3$, and maintained at a slurry temperature of 20° C. or more for an ageing time of 5 seconds or longer, with the further secondary slurry then used to repeat step (v), and vii) steps (v) and (vi) are iterated as required as a batch, semi-continuous or continuous process loop to form further builder granules.

9. The process of claim 5 wherein:

i) a primary slurry is formed by blending a primary aqueous solution of MGDA $Na_3$ with sufficient particles of solid amorphous MGDA $Na_3$ to provide an excess over an amount required to saturate the aqueous solution with MGDA $Na_3$ at the slurry temperature, and aged by maintaining the primary slurry at a temperature of 60° C. or more for an ageing time of 3 hours or longer, ii) the aged primary slurry is spray dried in accordance with step (B) of claim 1, with the resulting spray dried particles comprising solid crystalline MGDA $Na_3$ dihydrate split into first and second portions, the first portion proceeding to process steps according to steps (C) and (D) of claim 1 to form builder granules, iii) the second portion of spray dried particles comprising solid crystalline MGDA $Na_3$ dihydrate from step (ii) is used as seed particles in a process according step (A) of claim 1 to form a secondary slurry comprising seed particles of crystalline MGDA $Na_3$ dihydrate dispersed in further primary aqueous solution of MGDA $Na_3$, and maintained at a slurry temperature of 20° C. or more for an ageing time of 5 seconds or longer, iv) the secondary slurry is spray dried in accordance with step (B) of claim 1, with the resulting spray dried particles comprising solid crystalline MGDA $Na_3$ dihydrate split into first and second portions, the first portion proceeding to process steps according to steps (C) and (D) of claim 1 to form the builder granules, v) the second portion of spray dried particles from step (iv), comprising solid crystalline MGDA $Na_3$ dihydrate, is used as seed particles in a process according step (A) of claim 1 to form further secondary slurry comprising seed particles of crystalline MGDA $Na_3$ dihydrate dispersed in an aqueous solution of MGDA $Na_3$, and maintained at a slurry temperature of 20° C. or more for an ageing time of 5 seconds or longer, with the further secondary slurry then used to repeat step (iv), and vi) steps (iv) and (v) are iterated as required as a batch, semi-continuous or continuous process loop to form further builder granules.

10. The process of claim 5 wherein the primary aqueous solution of MGDA $Na_3$ has a concentration of from 35% to 55% by weight of MGDA $Na_3$.

11. The process of claim 1 wherein the compacted aggregates formed in step (D) have a minimum dimension of 300 μm or more.

12. The process of claim 1 wherein the compacted aggregates in step (D) are formed by compacting the spray dried particles in a nip between rotating rollers to form a compacted sheet having a thickness from 1 to 4 mm.

13. The process of claim 1 further comprising classifying the granular particles of step (D) by removal of undesired granular particles.

14. The process of claim 1 wherein the moisture content of the spray dried particles is from 5% to 15% by weight.

15. The process of claim 1 wherein at least 90% by weight of the builder granules have a particle size from 200 to 1400 μm as measured by sieving.

16. The process of claim 1 wherein compacting the spray dried particles into compacted aggregates is carried out with a composition consisting essentially of the spray dried particles.

17. The process of claim 1 wherein the alkali metal silicate has a molar ratio of $SiO_2/M_2O$ from 1.6 to 2.6.

18. The process of claim 1, wherein the alkali metal silicate molar ratio $SiO_2/M_2O$ is less than (1+R/9).

19. The process of claim 1 wherein the alkali metal M is Na, K or a mixture thereof.

20. The process of claim 19 wherein the alkali metal M is Na.

* * * * *